US009364769B2

(12) United States Patent
Kosmo

(10) Patent No.: US 9,364,769 B2
(45) Date of Patent: Jun. 14, 2016

(54) SURFACESCAPE FOR MULTI-DIMENSIONAL PLAY AND DISPLAY

(71) Applicant: Jennifer Lynn Kosmo, Port Orange, FL (US)

(72) Inventor: Jennifer Lynn Kosmo, Port Orange, FL (US)

( * ) Notice: Subject to any disclaimer, the term of this patent is extended or adjusted under 35 U.S.C. 154(b) by 70 days.

(21) Appl. No.: 14/308,435

(22) Filed: Jun. 18, 2014

(65) Prior Publication Data

US 2015/0367247 A1 Dec. 24, 2015

(51) Int. Cl.

| | |
|---|---|
| ***A63H 33/08*** | (2006.01) |
| ***A63H 33/42*** | (2006.01) |
| ***A63H 21/00*** | (2006.01) |
| ***A63H 18/00*** | (2006.01) |

(52) U.S. Cl.

CPC ..... *A63H 33/42* (2013.01); *A63H 18/00* (2013.01); *A63H 21/00* (2013.01); *Y10T 29/49828* (2015.01)

(58) Field of Classification Search

USPC ..... 446/85, 108, 110, 111, 117, 118, 124, 446/476, 478, 479

See application file for complete search history.

(56) References Cited

U.S. PATENT DOCUMENTS

| | | | | | |
|---|---|---|---|---|---|
| 1,935,542 | A | * | 11/1933 | Bursell | A63H 3/52 446/110 |
| 3,025,626 | A | * | 3/1962 | Schumacher | A63H 19/36 238/10 B |
| 3,414,194 | A | | 12/1968 | Weidler | |
| 3,701,214 | A | * | 10/1972 | Sakamoto | A63H 33/082 273/157 R |
| 4,270,303 | A | | 6/1981 | Xanthopoulos et al. | |
| 4,504,243 | A | * | 3/1985 | Barlow | A63F 3/00634 446/444 |
| 4,569,527 | A | * | 2/1986 | Rosenwinkel | A63F 3/00145 273/251 |
| D309,646 | S | * | 7/1990 | Halbert | D21/564 |
| 4,953,786 | A | | 9/1990 | Arsenault et al. | |
| 4,990,117 | A | * | 2/1991 | Yonezawa | A63H 18/10 446/129 |
| 5,212,842 | A | | 5/1993 | Glydon | |
| 5,326,267 | A | * | 7/1994 | Brokaw | G09B 25/06 273/241 |
| 5,417,603 | A | * | 5/1995 | De Chazal | A63F 9/1204 108/62 |
| 5,873,762 | A | * | 2/1999 | de Chazal | A63F 9/1204 108/62 |
| 6,322,415 | B1 | * | 11/2001 | Cyrus | A63H 18/14 446/130 |
| 6,328,500 | B1 | | 12/2001 | Rubio | |
| 6,427,926 | B1 | * | 8/2002 | Lai | A63H 18/02 104/53 |
| 6,431,936 | B1 | * | 8/2002 | Kiribuchi | A63H 33/046 446/129 |
| 6,761,563 | B1 | * | 7/2004 | Lin | G09B 5/062 273/153 R |

(Continued)

FOREIGN PATENT DOCUMENTS

| | | |
|---|---|---|
| GB | 2455515 A | 6/2009 |
| GB | 2455515 B | 2/2012 |
| WO | WO 2006044618 A2 | 4/2006 |

*Primary Examiner* — Kurt Fernstrom

(74) *Attorney, Agent, or Firm* — Lori J. Sandman

(57) ABSTRACT

A multi-purpose surface covering for interactive play and display is disclosed. The play or display environment, or surfacescape, is created by the user by combining the various components of the invention. The components interact so that they may be scaled to various sizes for use on floors, walls, table or counter tops, or other surfaces, and can be assembled outward as well as upward for play or display in multi-dimensional settings. As a play environment, it provides a set of easily interchangeable components that allow an unlimited number of colors, textures, shapes, and articles to be incorporated into the system. When displayed horizontally or vertically, this invention provides the capacity for interchangeable display of inserts, which may include but is not limited to artwork, advertising indicia, educational material (numbers, letters, etc.), instructional information, notices, or an infinite number of other materials which can be readily and changeably viewed.

25 Claims, 22 Drawing Sheets

(56) References Cited

U.S. PATENT DOCUMENTS

| | | | | |
|---|---|---|---|---|
| 7,470,166 | B2 * | 12/2008 | Allen | A63H 18/00 446/108 |
| 7,690,963 | B2 | 4/2010 | Whitehead | |
| 8,210,892 | B2 | 7/2012 | Thrush et al. | |
| 8,282,438 | B2 | 10/2012 | Tamulewicz | |
| 2008/0303212 | A1 * | 12/2008 | Lai | A63F 9/12 273/157 R |
| 2010/0199427 | A1 | 8/2010 | Anderson | |
| 2012/0200034 | A1 | 8/2012 | Braha et al. | |

* cited by examiner

SURFACESCAPE FOR MULTI-DIMENSIONAL PLAY AND DISPLAY

CROSS-REFERENCE TO RELATED APPLICATIONS

Not applicable.

STATEMENT REGARDING FEDERALLY SPONSORED RESEARCH/DEVELOPMENT

Not applicable.

BACKGROUND

The present invention relates generally to play areas and display systems, and more specifically to individually arranged and assembled tiles, forms, and articles for interactive play and display. The components interact so that they may be scaled to various sizes for use on floors, walls, table or counter tops, or other surfaces, and they can be assembled outward as well as upward for play or display in multi-dimensional settings. When displayed horizontally or vertically, this invention provides the capacity for interchangeable display of inserts, which may include but is not limited to artwork, advertising indicia, educational material (numbers, letters, etc.), instructional information, notices, or an infinite number of other materials which can be readily and changeably viewed.

A favorite play activity involves toys that incorporate play upon a surface, such as a floor, table, counter, or other surface. Play may include toy vehicles that can be moved along roadways, runways, railways, waterways, or other travel paths, or may be parked inside or outside of play structures to simulate real-world environments. Surfaces for this type of play include rugs, mats, play boards, and tiles that interlock to create relatively flat or one-dimensional elements of a track or landscape. They often involve invariable patterns and are scaled for specific sized accessories, and therefore do not support use with multiple toys. Also, these play structures generally do not provide a way to adhere three-dimensional elements that can removeably affix to the play surface to prevent them from slipping or moving about the surface.

Toys utilizing play surfaces with connecting or connectable pieces have been described. Various car and truck, train or other transportation-based layouts are present in the prior art. Additionally, mats comprising variously patterned and ornamented connecting parts have been described. The present invention improves on and is distinguished from the prior art foremost in that it has easily interchangeable components, allowing for an unlimited number of colors, textures, shapes, and articles which can be incorporated into the system. The play or display environment, or surfacescape, is created by the user by combining the various components of the invention. It offers the user the unlimited opportunity to build upward and outward from a surface, making the surfacescape truly multi-dimensional. A discussion of the related art of which the inventor is aware, and some of the differences and distinctions from the present invention are provided.

DESCRIPTION OF RELATED ART

This invention is unique in that it offers the user a single set of elements that can be used for both play and display. It can be made and used with an infinite number of changeable scenes or display backgrounds, including but not limited to roadways, runways, watercourses, or other interconnectable travelways that wind to or through changeable background scenery, landscapes and structures. It may connect to form simple travelways or whole cityscapes, and can hold and incorporate inserts that are printed, ornamented or treated with new and changeable images, textures or text, selected by the user.

Unlike existing floor mats and tiles in the prior art that contain pre-cut or pre-printed alphabetic, numeric or shapes that are fabricated on or extend through the surface of mats or tiles, this invention allows the user to change, replace, expand, and repurpose components, and therefore mature with the system.

Several examples of toy car tracks or roadways exist in the prior art. Seitzinger, et al., describes a toy car racetrack that allows connection and continuation through the component parts of the trackways at the midpoint of each side, forming a racing circuit. This invention is specific to roadway and terrain elements, with slot and embedded conductors aligned to form a closed circuit. In contrast, the present invention is capable of forming open and changeable travelways, and may connect to form not just a track, but a complete and changeable landscape. Similarly, Rubio teaches a kit for assembling a closed-loop toy simulation of a roadway comprising at least four curved road segments and at least two straight road segments, each road segment having at least one marking on such surface that simulates roadway lane markings. This invention is also restricted to a roadway, and does not offer changing landscape upon which the user can play or display a variety of different play environments; it has variously shaped components which do not all independently connect, as does the present invention. It is assembled in an end-to end configuration, whereas the present invention meets and connects with other interchangeable tiles on all sides. The present invention is designed not to be closed-looped, but rather openly configured to allow continuous and non-continuous extensions of roads, waterways and travelways through and to various landscapes and structures in multiple directions and dimensions.

Mats or tiles used with racetracks and roadways have also been disclosed. Allen teaches a toy race track providing a mat for simulating a stock car racing track. As previously described, the present invention provides more than a race track; it offers an endless variety of cooperating scenes upon which play can be accomplished. The interconnecting tiles support a limitless variety of insertable accessories which complement travelways or other scenery and play environments, and are capable of building upon many levels moving upward and outward from the surface. Arsenault also teaches tiles used as a toy roadway, each tile having a roadway pattern and capable of interlocking with adjacent tiles. This invention requires the integration of body parts, spacers, tab plates, and rivets to form the roadway. It also includes raised land areas elevated above the roadway. The present invention is different in that it utilizes scalable, interchangeable tile pieces to form the basic elements of the travelways which include roads, waterways, runways, train tracks and other types of pathways, not just roadways, and background areas that are consistently sized to allow for play or display upon a substantially flat surface if the user desires, so that the user can sit, stand, and otherwise play comfortably upon the surface. If the user chooses, he or she can incorporate three-dimensional elements, including dimensionalizing tiles capable of interacting between proximate tiles, of varying textures and shapes around which play can occur. These dimensionalizing tiles interact ornamentally as well as structurally. The present invention additionally allows attachment of upper levels to the raised elements, so that users can build perpendicular to the surface, creating multi-level buildings, ramps to upper roadways, underpasses, and other multi-dimensional structures. And, the interchangeable tiles can be configured in an unlimited number of ways to provide continuously changeable artwork, background and scenery, or elements to display.

Various examples of tiles used for building structures in play settings also exist, but can be distinguished structurally and functionally from the present invention. Xanthopoulos describes a toy building tile unit adapted to provide a building panel in which edge margins of the panel are offset on both top and bottom of the tile; one of the offset edge margins serves as a carrying means for interlocking with another tile. This invention is for creating buildings; individual components do not stand alone and it does not include a surface on which to play. The present invention includes building or structure components as an interchangeable accessory of the invention, along with other possible collapsible accessories that are removeably attached to the surface to facilitate play or presentation upon the surface or display. Smail describes a construction toy that comprises interlockable tiles assembled to form patterns. The present invention offers simpler ways to connect tiles, allowing the pieces to be easily and independently interchangeable. The variously shaped pieces required to assemble the Smail toy make putting it together more complex than the present invention, which utilizes tiles that are generally a consistent or scalable size and shape. Also, the present invention offers multiple ways of attaching or connecting the variously configured tiles in the set—base mats, extensions or recessions, or frame connectors, or combinations of these connecting methods can be used.

Pads or mats for play have also been described. Glydon describes an interlockable foam pad with multiple layers of varying density that interlocks to form three-dimensional structures or a foam pad exercise mat. It includes sections adapted to interlock together with slight hand pressure to the adjacent foam pad. An embodiment of the present invention consists of foam tiles of uniform density. In addition to forming a surface cover, it functions as an interactive play or display surface utilizing differently ornamented and shaped pieces or accessories. The basic pad, or mat, formed by the foam tiles in one configuration of the present invention includes apertures or recesses into which said pieces or accessories can be placed, removed and replaced by other pieces or accessories to provide stimulating and changeable play or display environments. Anderson teaches play mats having a surface for play with various scenes, and includes a plurality of puzzle pieces with uniform puzzle edges that can be assembled in many orientations, and a plurality of border pieces. One of the ways the present invention can be distinguished is that instead of border pieces, tiles of the mat may contain a built-in frame into which various inserts can be added, including textured, writeable, alphabetical or alphanumeric elements, advertising indicia, or other components. They can be resurfaced by the user. Additionally, the present invention allows the user to insert and create multi-dimensional forms and structures contained within or directly upon the tile surface.

Toy building systems involving mats and accessories used with these mats have also been described. Evans, et al., describes a structure building system that utilizes a mat, a set of pillars and a set of structural members to build a structure. This invention is distinct from the present invention in that it does not include changeable scenery around which the structures can be incorporated. Although "landscape mats" are described, their function and form are completely different from the interchangeable surface environment disclosed herein. Also, Whitehead relates to a play mat and articles placed thereon. The play mat includes at least a portion, more typically a layer, of a magnetic or magnetically attractive material such as a metalized compound. Disadvantages associated with metal or magnetic connections include danger of swallowing for very young children, the need to embed or attach magnets to all pieces, and increased cost. The present invention utilizes connection methods and accessories that do not require magnets to connect; it is safer without magnets and can be produced and sold at a lower cost. Articles can be inserted directly into apertures or punch-outs in the mat; this makes them sturdy yet easy to move and manipulate without the need for magnetic coupling. Thrush, et al., describes a toy floor mat system. The floor mat has removable play pieces within tiles that can be connected to form play figures or three-dimensional structures. It does not accommodate insertion of different changeable pieces with various artwork, textures or surface indicia. It is also specific to floor use, and the various inserts are shapes cut out from the mat itself. It does not contemplate use as a display.

Generally, the prior art contemplates the use of artwork, shapes or travelways that are either unique to one system of mats or tiles, or contain travelways preprinted on mats with ornamentation that cannot be varied. The use of tessellating, interchangeable tiles containing surface ornamented or routed channel travelways including roadways, railways, runways, waterways, pathways, etc. arranged, aligned, and combined with non-travelway ornamented tiles and their ability to interact to create a continuous surface area which can be multi-directional and multi-dimensional is unique to this invention. Different travelways contained within the same system allows for the use of different types of vehicles to be played with along the same system.

With the invention disclosed herein, the user can select, combine, and create multiple travelway systems with tiles and create their own layout incorporating non-travelway ornamentation tiles. Travelways do not have to take on a closed loop configuration, but can terminate within the same tile or extend to other tiles ornamented with travelways. For example, "paved" roadways can be coupled with "dirt" roadways or tiles without travelways leading to tiles ornamented with parking lot lines, "paved" surfaces such as driveways, landscapes, structures including garages, hangars, roundhouses, tunnels, and the like of this invention.

Furthermore, the dimensionalizing tiles with travelways and dimensionalizing forms of this invention allow the user to connect travelways upward and outward from the first surface to create multiple levels of travelways such as raised highways and structures. Additionally, narrower travelways can connect with larger travelways and vice versa through the design or scaling of the tiles. Also, the combination of component parts allow the user to create structures (i.e. dollhouses, buildings, and shapes) or a flat surface with various tile configurations and ornamentation for learning or display, which makes the system truly multi-functional.

SUMMARY

It is desirable to have a changeable play or display surface that is assembled in any configuration preferred by the user, made by easily connecting complimentary components to form multi-functional, multi-directional and multi-dimensional surfacescapes. The preferred embodiment comprises a soft and relatively flexible, yet sturdy material, without sharp or hard edges so that even very young children can play safely with or upon it. Scalable, interchangeable tessellating tiles can be assembled and built upon using collapsible connecting elements and inserts that attach various levels with an endless variety of surface materials and designs. Framed areas and channels in the tiles provide space to add visual, adhesive or structural elements, and punch-outs and juts create a means for inserting perpendicular components to allow for extending play or display beyond a flat surface. By providing scenery and accessories such as ramps and structural pieces that are selected and added by the user, the invention can be used to build upwards as well as outwards. It encourages stimulation and learning by presenting a spectrum of textures, colors, dimensions, and elements controlled and individually selected and directly applied to the surface by the user. Accessories and articles can be added, collected, changed, and can mature with the user. It is further desirable to provide a surface assembled by the user through which a user can travel, or move through to different play or learning environments.

As a play surface, the present invention offers a way to provide colors, texture, artwork or elements such as numbers and letters for the player to touch, place, and interchangeably manipulate and build with. It can be used with a mat base, where tiles and elements are connected upon the mat, or the tiles can be joined to each other directly using extensions and recessions in the tiles, or frames that enclose raised portions on the tiles themselves, or combinations of these means for connection. As the tiles are connected, a surface is constructed upon which one can play, walk on or through, stand or ride upon. It can also be constructed on a table or countertop for use at eye level.

In addition to serving as a play surface, this invention offers the added benefit of functioning as a display. Besides being placed and built upon a horizontal surface, it can be hung vertically. It serves as an easily visible and interchangeable horizontal or vertical teaching environment. It can provide changing directions, instruction, or visually stimulating material that can extend dimensionally. Some examples of use can be, but are not limited to, presentations, multi-dimensional scaled architectural rendering, artwork or wall covering as decoration, for advertising or displaying notices. It may include writeable surfaces such as paper, card, white or chalk board, attachable surfaces such as Velcro or Colorform, or commercially identifying indicia such as ads, logos, etc. Furthermore, this invention contemplates various versions in different scales, so that it can be made as a travel kit, a floor or table surface, or on a larger scale for whole room size to include play or display in homes, offices, schools, museums, outside areas, or other large spaces.

The multi-functionality of this system has the added benefit to the environment and the users of creating less waste. The underlying tiles can be repurposed and transformed from a play to a display area with the changing of insert tiles and not the complete system. Users won't have to throw out single function play or display pieces.

The various tiles described in the claims include configurations in multiple and proportional sizes, and those with areas including continuous top and bottom surfaces (continuous); tiles recessed from the top surface downward or the bottom surface upward (closed frame); those open from top surface to bottom surface (open frame); surfaced interior (insert); tiles which are recessed around a raised portion (panel); combinations of the aforementioned, and other configurations consistent with the specification and claims presented.

Tiles can be further varied with routed channels that accept track, road or other travelway pieces (routed). For example, Lionel or HO gauge train track or Hot Wheels or other toy vehicle sets could be used within and upon the invention. By placing track within the routed channels, the track can be securely held in place. In a preferred embodiment, EVA foam tiles with routed channels exhibit a slight spring when pressed and released, which holds the track in place with just enough pressure to keep it steady; when the foam is depressed or pressed away, the track can easily be removed.

The tiles described are incorporated into a set or system utilizing connecting and building components. They may be joined together by one or more separate connection means, which can be used separately or together to add strength to the connections as well as flexibility for the user to create individual surfacescape designs. Connection of proximate tiles can be accomplished by extensions and recessions which are part of the tiles themselves; placing the tiles upon mats which hold tiles in place; or frame connectors which incorporate raised areas on the tiles and frames which fit around the raised areas and hold together tiles placed adjacent to one another.

Building components that enable multi-dimensional assembly, construction and play include but are not limited to insert tiles, ramps, walls and pillars with protrusions, or juts that can be positioned into and held within punch-outs or recessed areas on tiles throughout the surfacescape. Punch-outs and corresponding juts are spaced based on the dimensions of the smallest tile in the set. These building components, as well as accessory articles used to enhance the play or display experience, can either be pre-formed or may be assembled from a flat posture for packaging and storage, and are either positioned or folded together and inserted into frames or punch-outs or recessed areas as desired by the user. When inserted, tiles proximately positioned or folded accessory articles occupy and are held within punch-outs.

A variety of materials are contemplated for the components of this invention, including: foam (including ethylene vinyl acetate (EVA) or a variety of environmentally friendly foam (EFF) foams); rubber or rubber like materials (including thermoplastic elastomer (TPE)); cardboard (chipboard); wood (including 5 ply birch); acrylic; and may also comprise a variety of eco-friendly products made from recycled materials.

The ornamentation of tiles, mats, forms, and other components of the invention can be achieved by printing directly upon the component surface or on a suitable substrate which can be applied to the component by means of adhesive bonding or suitable lamination process (including thermal lamination, flame lamination, or pressure sensitive lamination). If lamination is used, bonding of the substrates can form bi- or tri-laminates. Furthermore, surface modification of tiles can alter the material surface by pattern, size of pattern, spacing between patterns, locations of each pattern, and depth of cut(s).

The terms single material depth and multiple material depth refer to the tile or insert component relative depth. Since the invention is designed to be both scalable and proportionate at different sizes, this refers to the depth dimension of the given component. For example, an insert tile that sits in a closed frame tile configuration would separately be a single material depth, because the underlying component—the frame tile underneath the recess or aperture—would also be a single material depth. Therefore, when combined, the insert and the frame tile constitute a multiple material depth, and would render the surface of the tile plus insert continuous; they would then also be continuous when releasably coupled with proximate tiles. Multiple material depth simply means a plurality of the single material depth.

The present invention utilizes scalable and proportional individual tiles that are joined to connect, extend, and infinitely expand the play and display surface in all directions.

Variously configured tiles accept components of many textures, colors or surface qualities that can be interchanged after the surface is assembled.

REFERENCE NUMERALS USED IN THE DRAWINGS

1. Continuous tile
3. Extension
5. Recession
10. First surface
15. Second surface
20. Punch-out
23. Routed tile
25. Routed channel
30. Insert tile
32. Multi-dimensional insert tile
33. Sloping tile
34. Panel tile
35. Jut
40. Press aperture
50. Frame tile
53. Support form
55. Long wall support form
60. Short wall support form
65. Support wall tabs
70. Door opening in support form with brick as an example of ornamentation
75. Solid wall support form with ornamentation
80. Window openings in support form with brick ornamentation
85. Pillar
90. Angled pillar
95. Connector jut
97. Jut port
100. Routed pillar groove
105. Corner panel
110. Frame connector
115. "V"-cut
125. Mirror-image of article prior to folding
130. Article
135. Raised panel mat
140. Raised frame mat

FIGURES OF THE DRAWINGS

These and other features, aspects and advantages of the present invention will become better understood with regard to the following description, claims and accompanying drawings where:

FIGS. 2C-2M show alternate possible ornamentation to provide travelways and allow continuity between proximate tiles of the set:

Figure 2A:
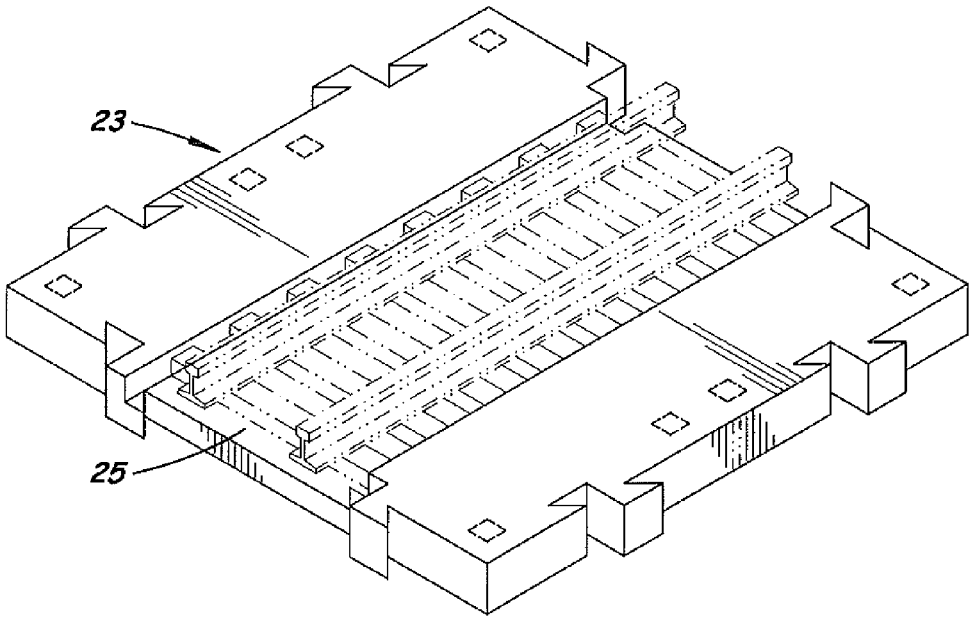
FIG. 2A shows a perspective view of the routed tile, which has been routed to include a channel for placing track or other travelway.
Figure 2B:
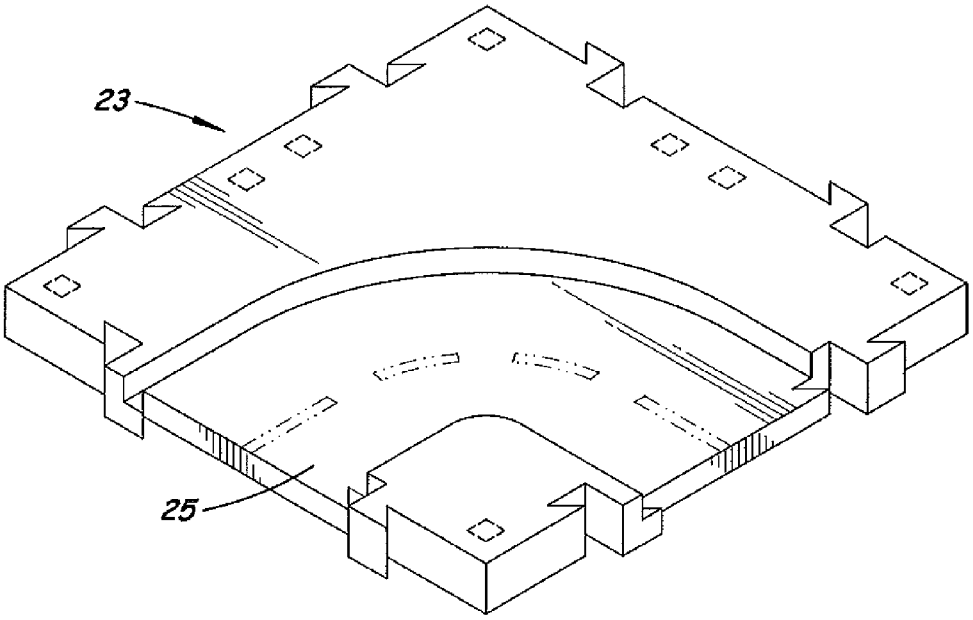
FIG. 2B shows a perspective view of an alternate embodiment of the routed tile channel on a tile with extensions and recessions and punch-outs.
Figure 2C:
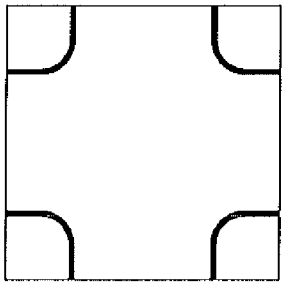
Figure 2D:
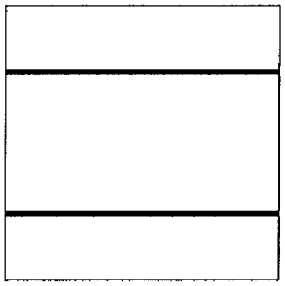
Figure 2E:
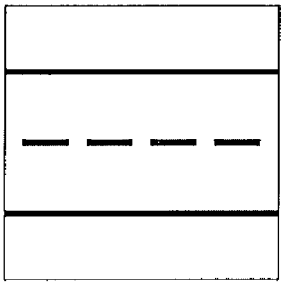
Figure 2F:
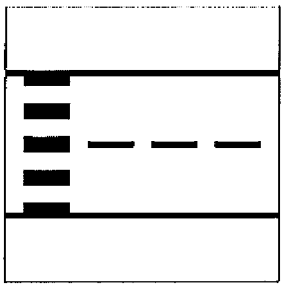
Figure 2G:
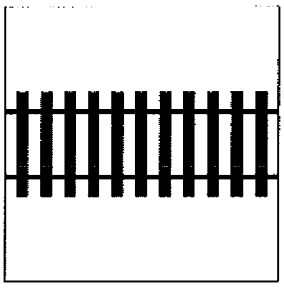
Figure 2H:
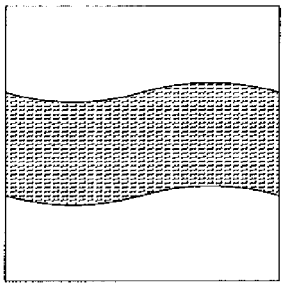
Figure 2J:
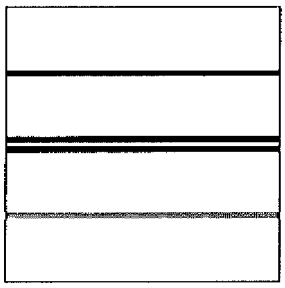
Figure 2K:
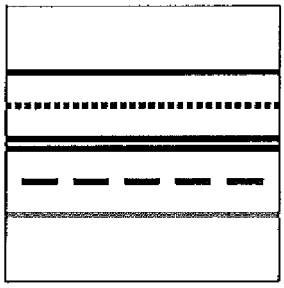
Figure 2L:
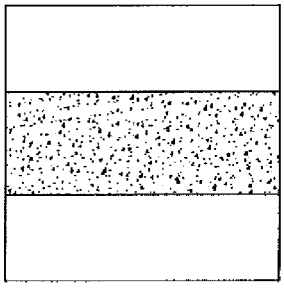
Figure 2M:
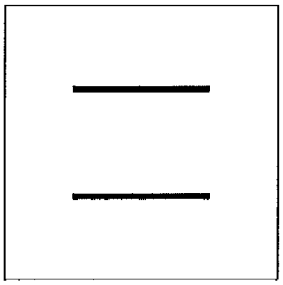

FIG. 2C shows an intersection.
FIG. 2D shows a single lane road.
FIG. 2E shows a divided lane road.
FIG. 2F shows a runway.
FIG. 2G shows railroad tracks.
FIG. 2H shows a waterway.
FIG. 2J shows a multiple-lane road.
FIG. 2K shows a multiple divided lanes road.
FIG. 2L shows a walkway.
FIG. 2M shows a parking area.

Figure 3A:
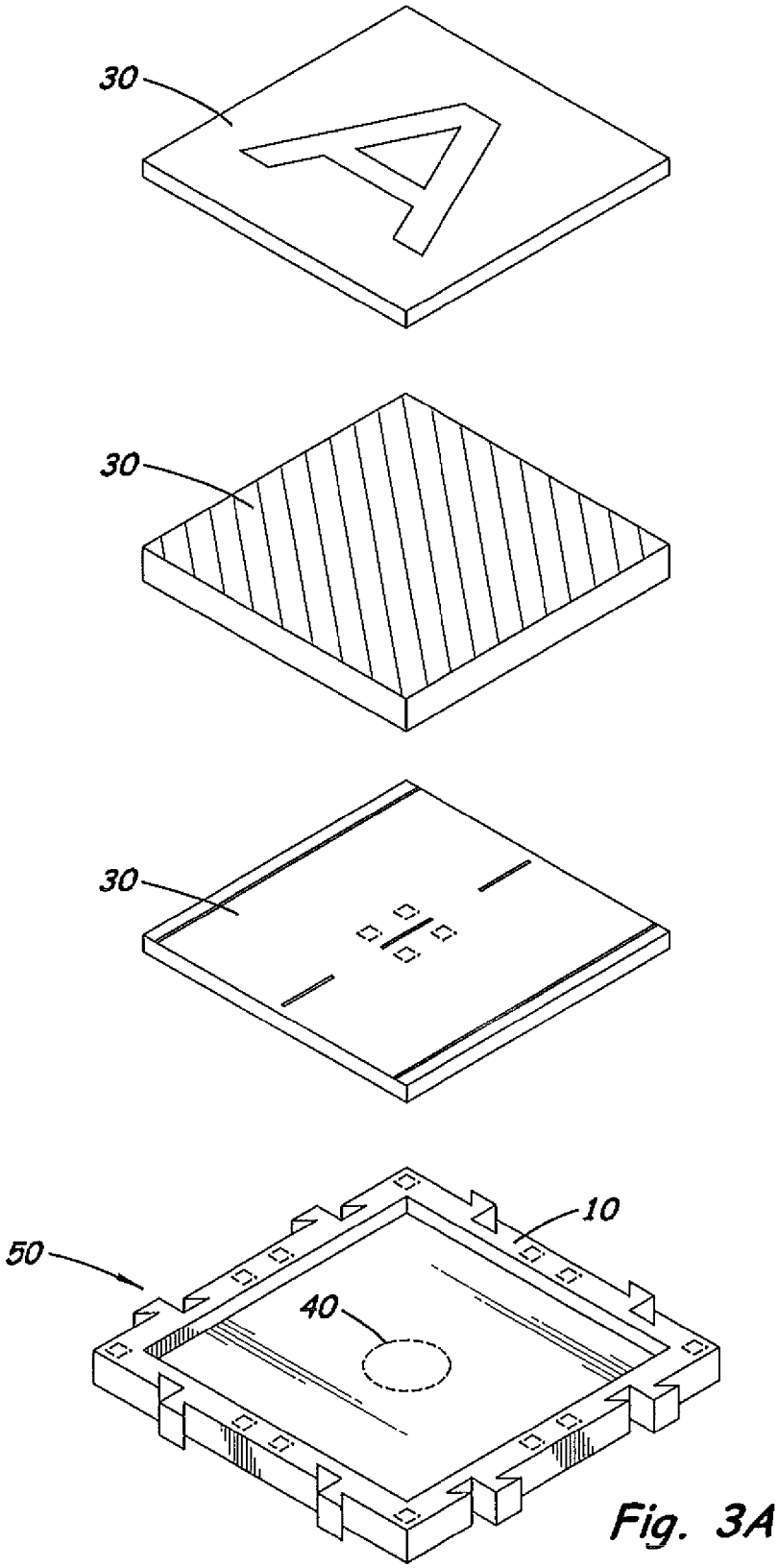

FIG. 3A shows perspective views of several variations of insert tiles and the closed frame tile into which the insert tile is positioned.

Figure 3B:
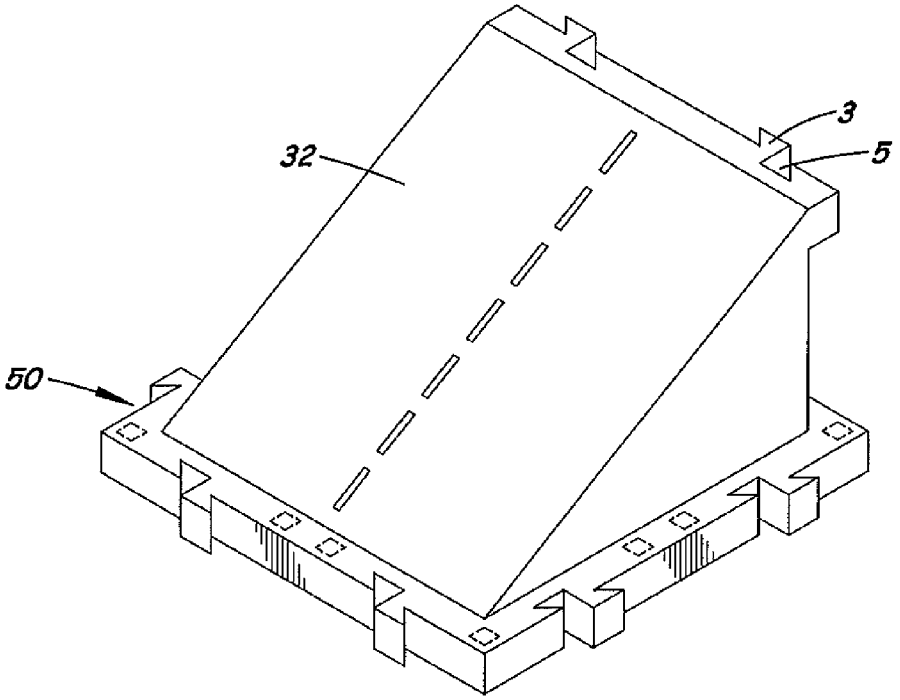

FIG. 3B shows a multi-dimensional insert tile within a frame tile.

Figure 3C:
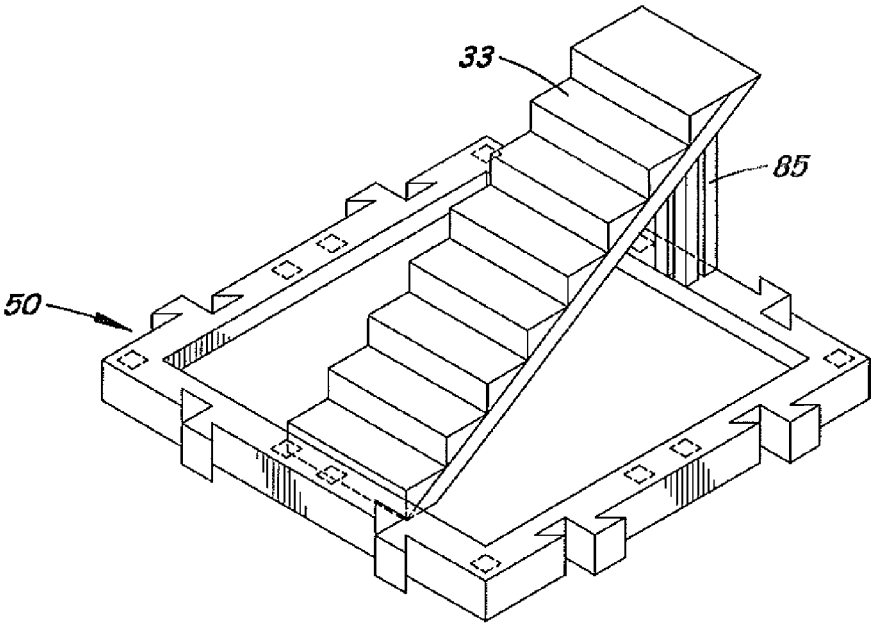

FIG. 3C illustrates a sloping tile configured as a staircase, positioned within a frame tile and supported by an angled pillar.

Figure 4A:
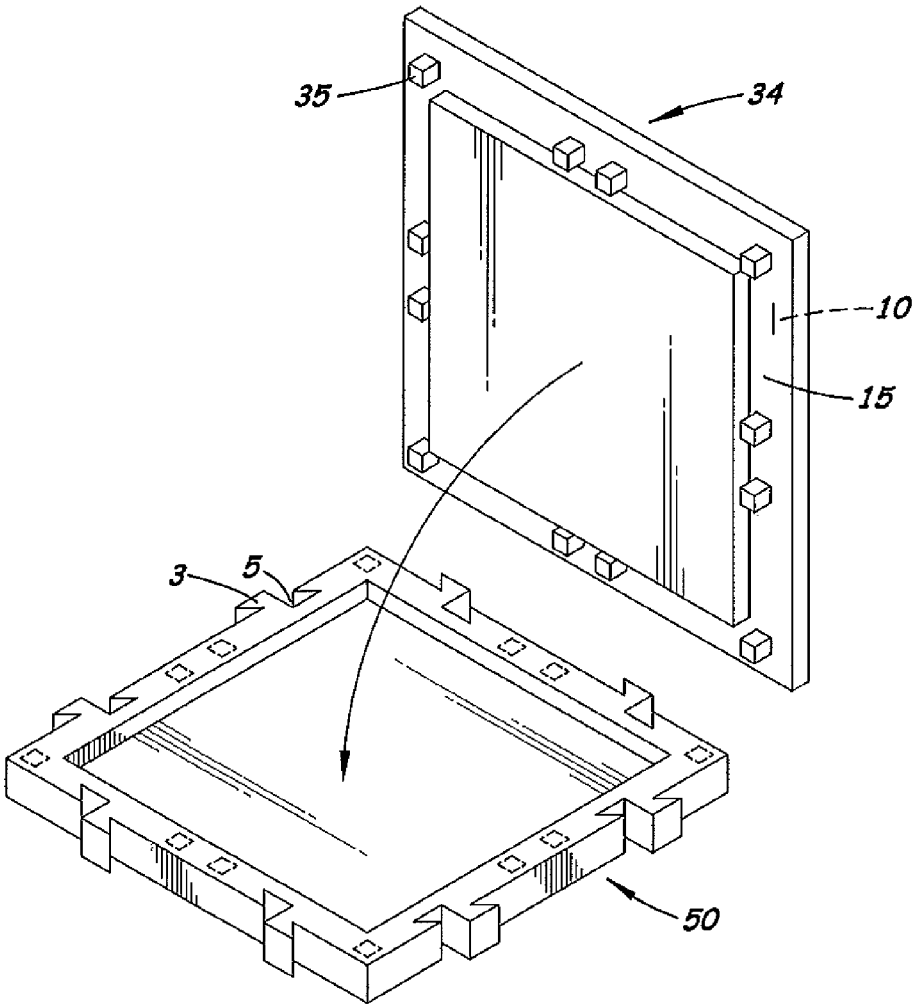

FIG. 4A shows a perspective view of a panel tile with juts and also the closed configuration frame tile into which the panel tile may be positioned.

Figure 4B:
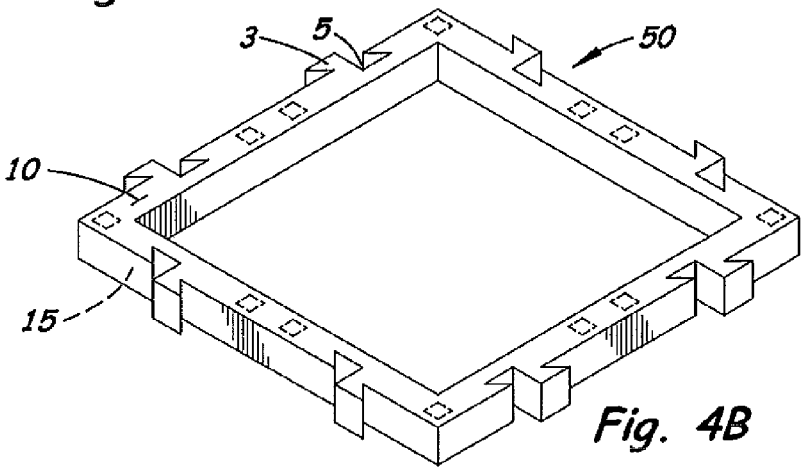

FIG. 4B shows an open configuration frame tile, which could be a single or multiple material depth to accommodate insert tiles of various depths.

Figure 5A:
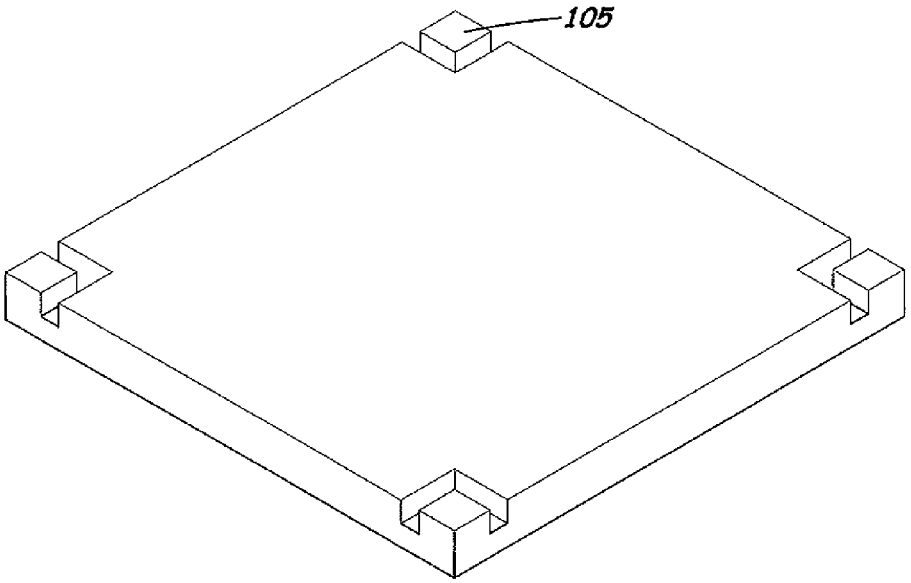

FIG. 5A is a perspective view of a continuous tile without extensions or recessions (smooth sides) and with routed corner panels.

Figure 5B:
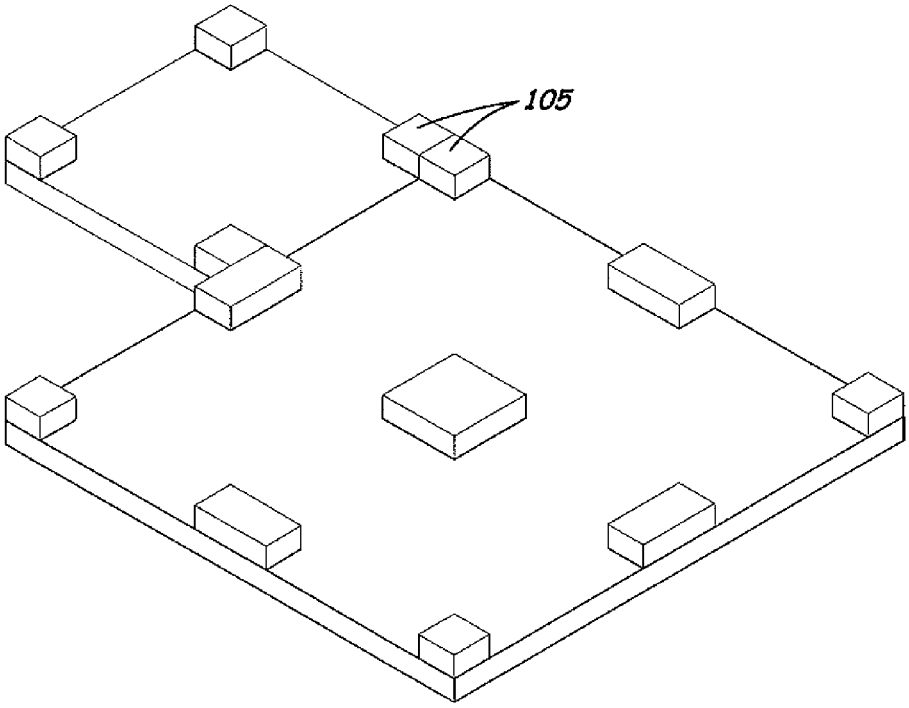

FIG. 5B illustrates a panel tile with multiple raised areas and corner panels, and the multiple and proportional nature of the tiles.

Figure 5C:
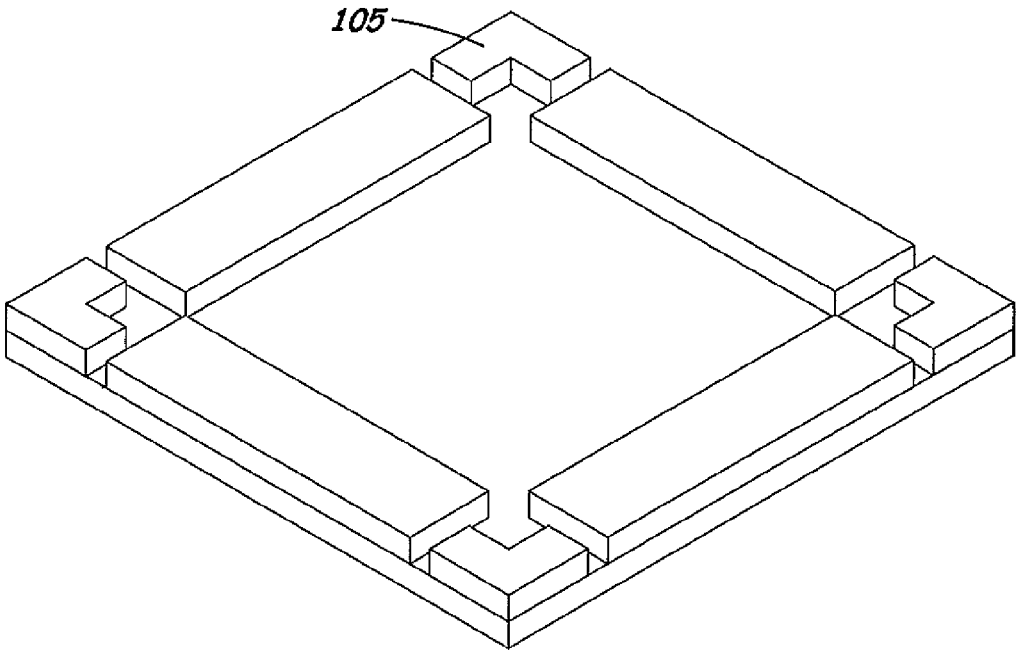

FIG. 5C shows an embodiment of a closed frame tile with routed corner panels which cooperate with frame connectors.

Figure 5D:
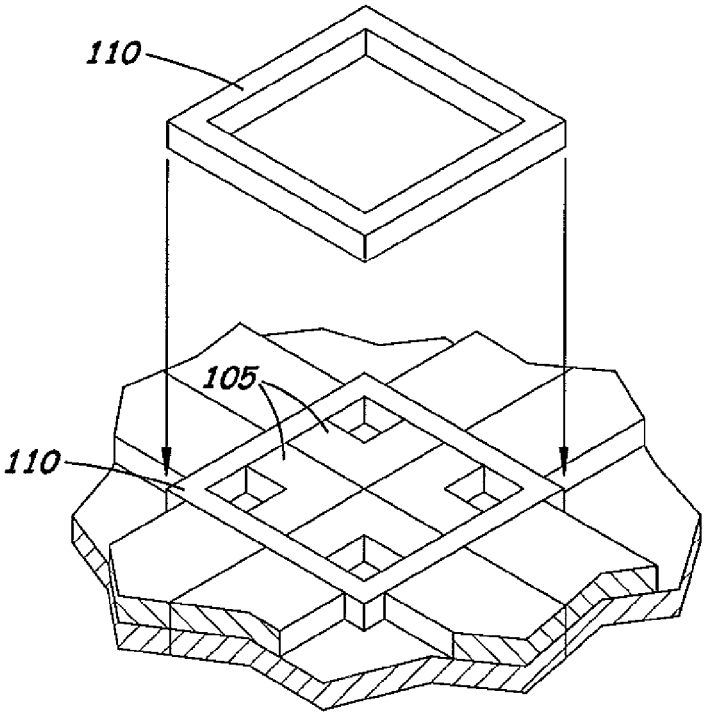

FIG. 5D shows adjacent closed frame tiles connected by enclosing the corner panels with a frame connector.

Figure 6A:
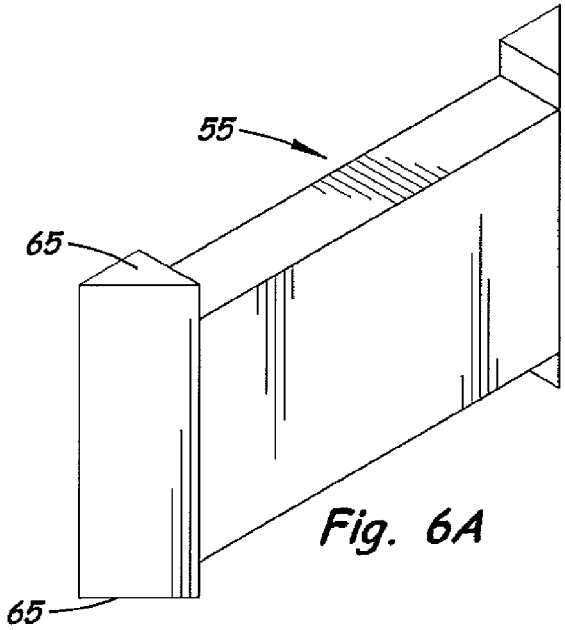

FIG. 6A shows a perspective view of a support form configured as a long wall.

Figure 6B:
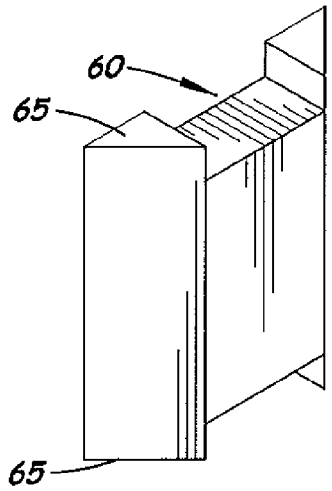

FIG. 6B shows a perspective view of a support form configured as a short wall.

Figure 6C:
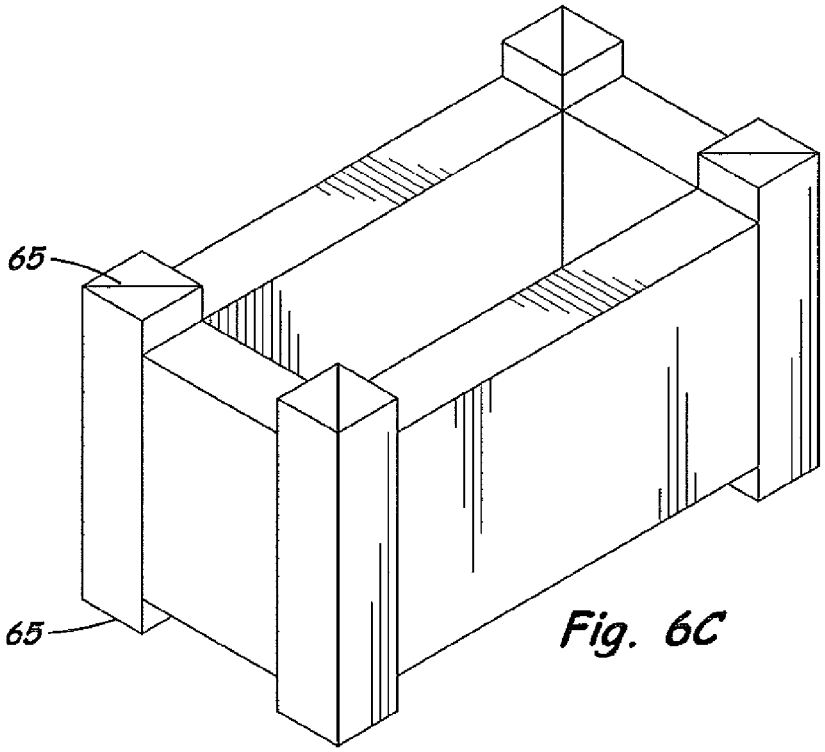

FIG. 6C shows a perspective view of support forms assembled to make a basic building structure.

Figure 7A:
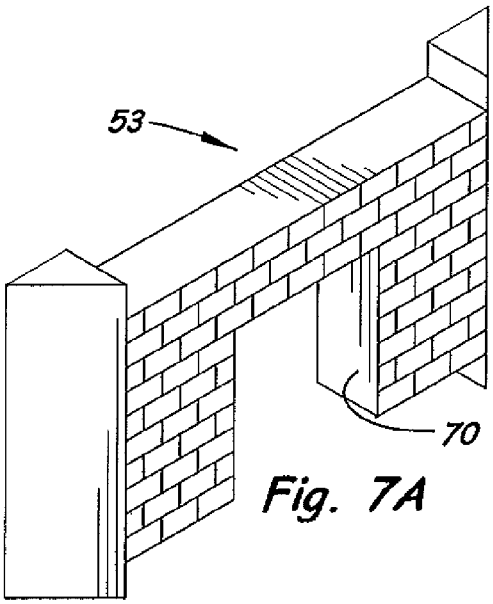

FIG. 7A shows a support form configured as a wall with brick ornamentation that includes a door opening.

Figure 7B:
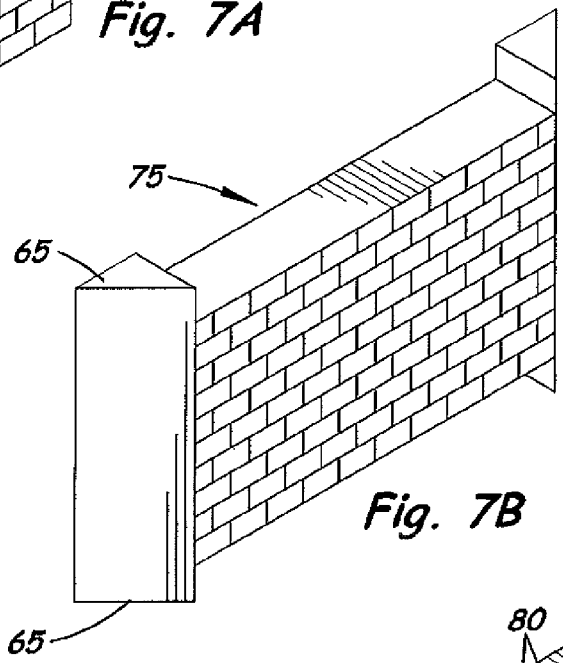

FIG. 7B shows a support form configured as a solid wall with brick ornamentation.

Figure 7C:
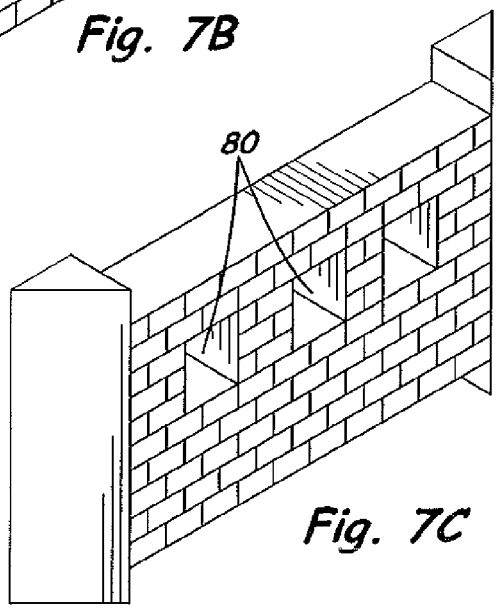

FIG. 7C shows a support form configured as a wall with brick ornamentation that includes window openings.

Figure 8:
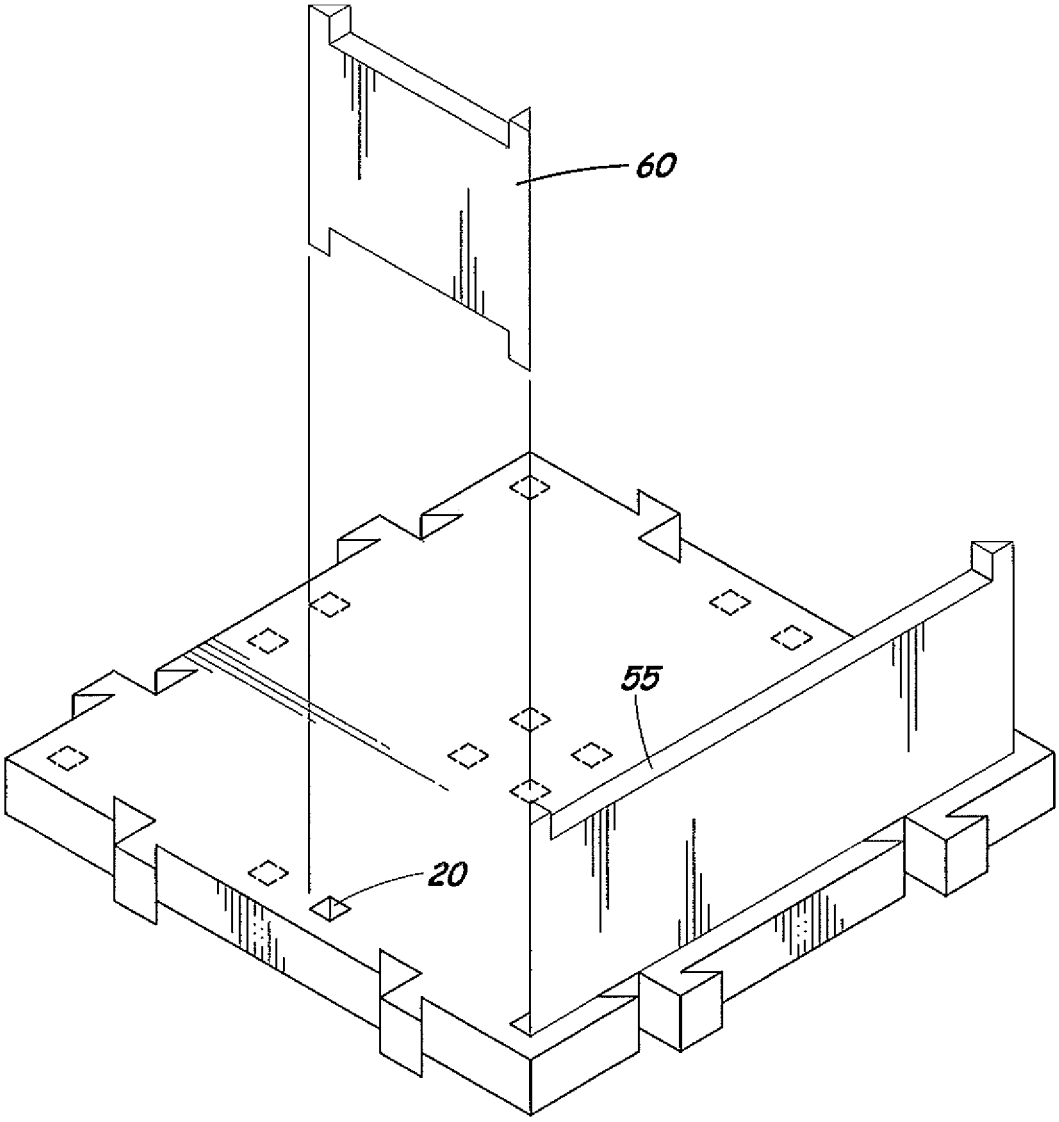

FIG. 8 shows support forms described in FIGS. 6 and 7; they are shown from above the tile surface being moved into position within the punch-outs.

Figure 9A:
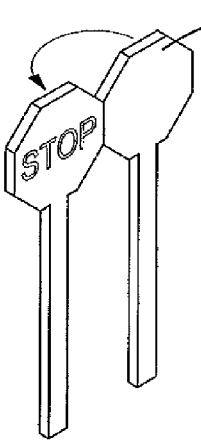

FIG. 9A shows an article configured as a stop sign in its flat or unfolded posture.

Figure 9B:
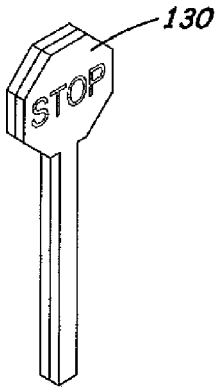

FIG. 9B shows the article of FIG. 9A folded for insertion.

Figure 9C:
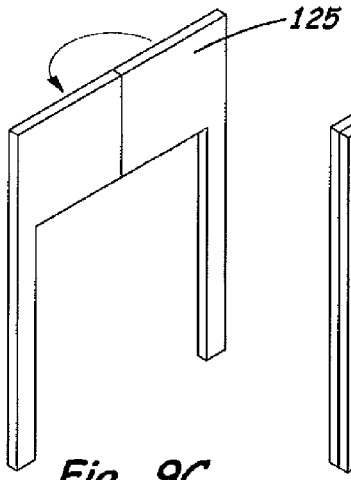

FIG. 9C shows an article configured as a flag or travelway sign in its flat or unfolded posture.

Figure 9D:
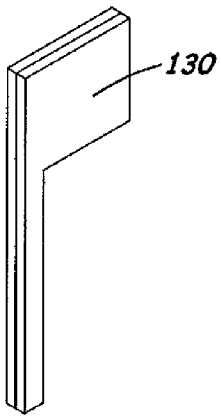

FIG. 9D shows the article of FIG. 9C folded for insertion.

Figure 9E:
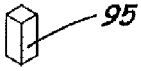

FIG. 9E shows a connector jut from a removeably blocked punch-out.

Figure 9F:
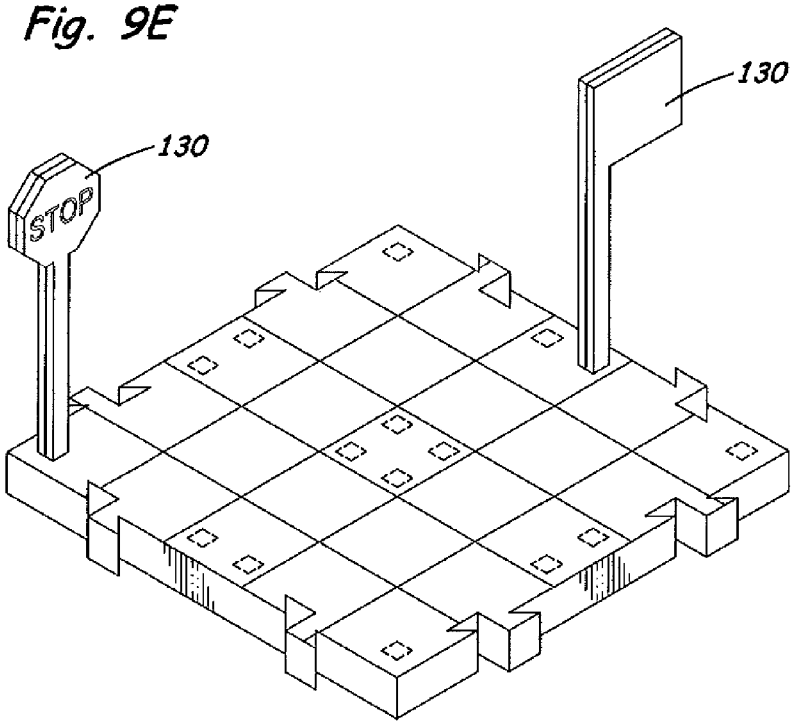

FIG. 9F shows the articles of FIGS. 9A and 9C positioned within punch-outs of a tile.

Figures 10A, 10B, 10C:
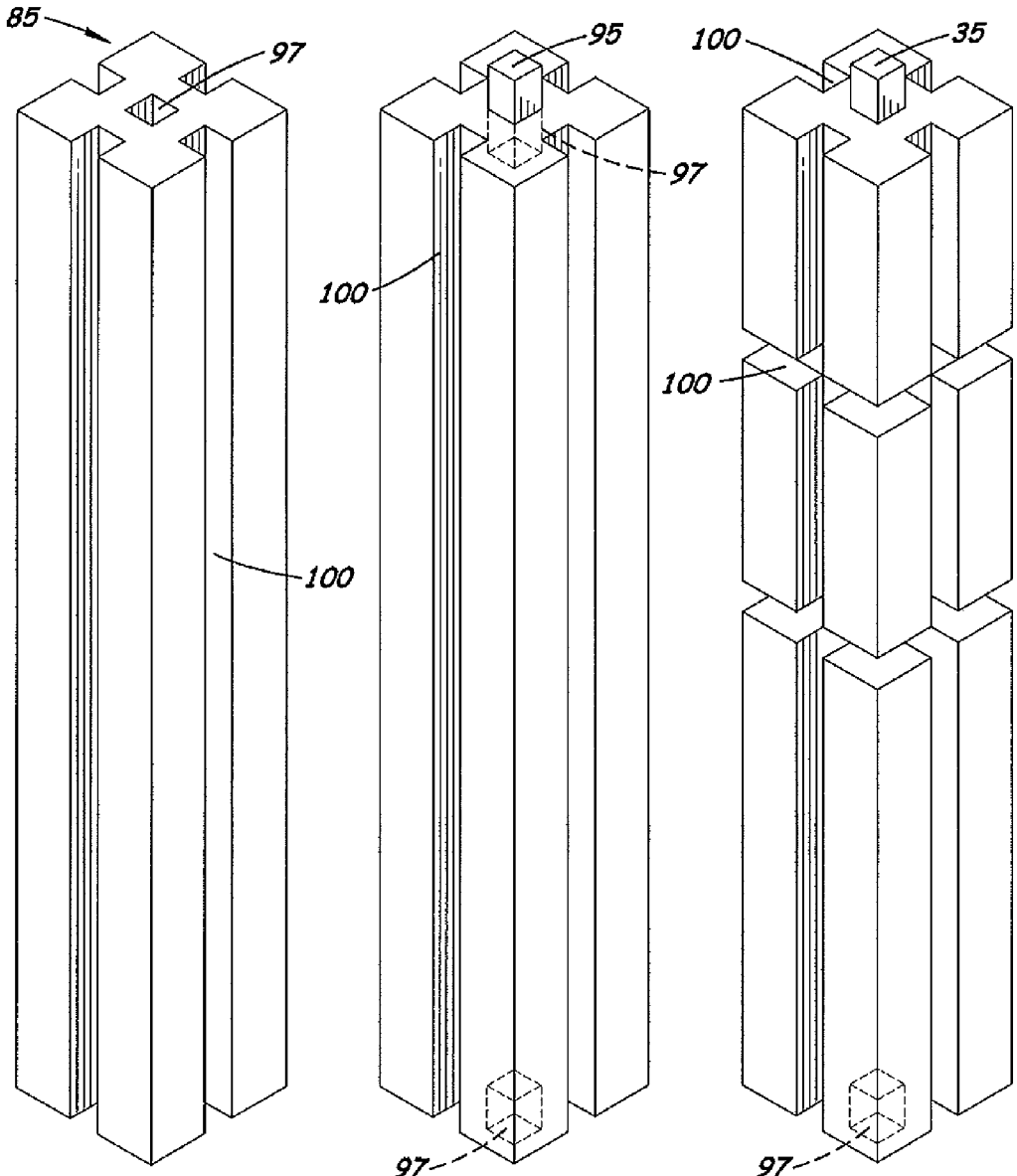

FIG. 10A shows a perspective view of a pillar and illustrates the pillar jut port.

FIG. 10B shows a perspective view of a pillar with jut ports at opposite ends, and a connector jut inserted in a jut port, and vertical routing.

FIG. 10C shows a perspective view of a pillar and illustrates the pillar jut with a jut port at its opposite end, drawn as dotted lines, with both horizontal and vertical routing.

Figure 10D:
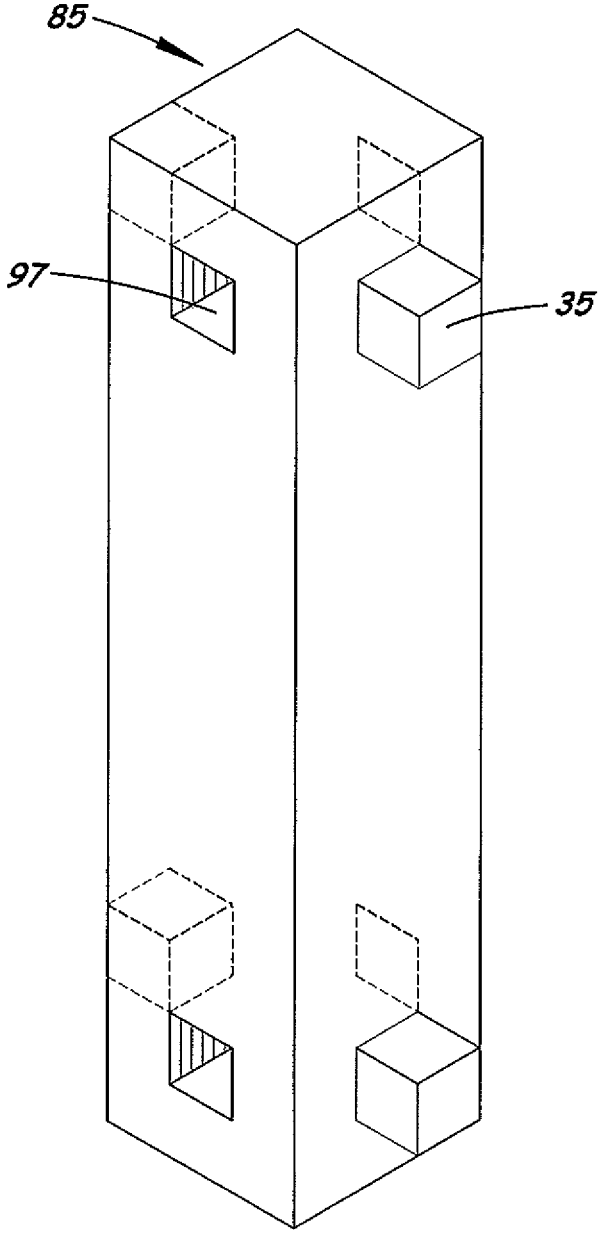

FIG. 10D shows a pillar configured to include juts or jut ports in different surfaces.

Figure 10E:
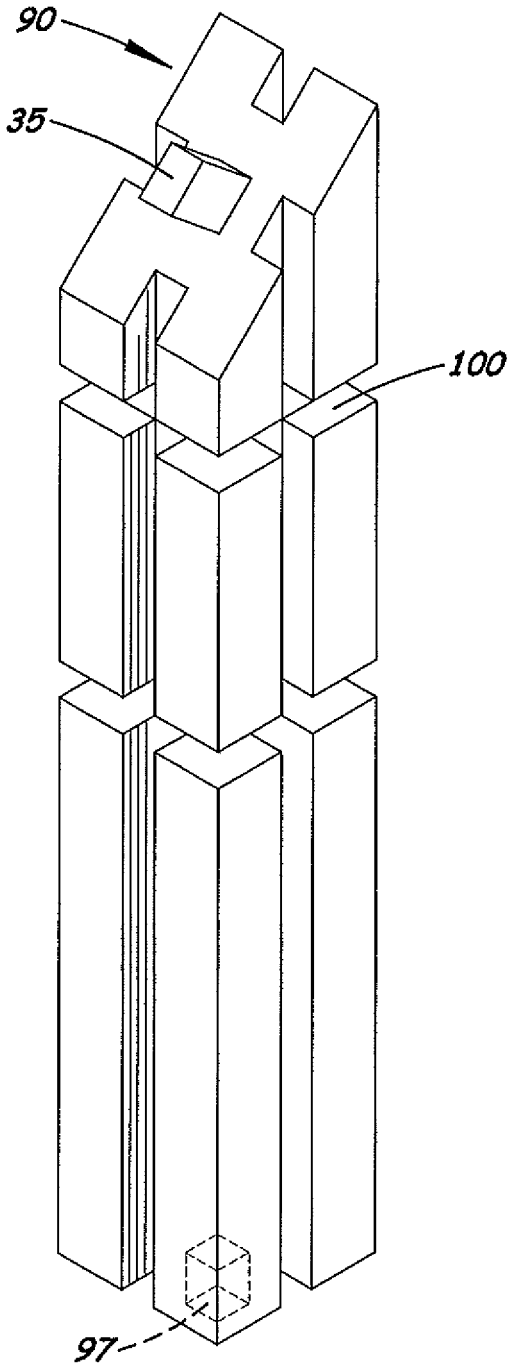

FIG. 10E shows two pillars being connected, with an angled pillar including both horizontal and vertical grooves; it also illustrates the pillar jut on the angled surface and the jut port within illustrated as dotted lines.

Figure 11A:
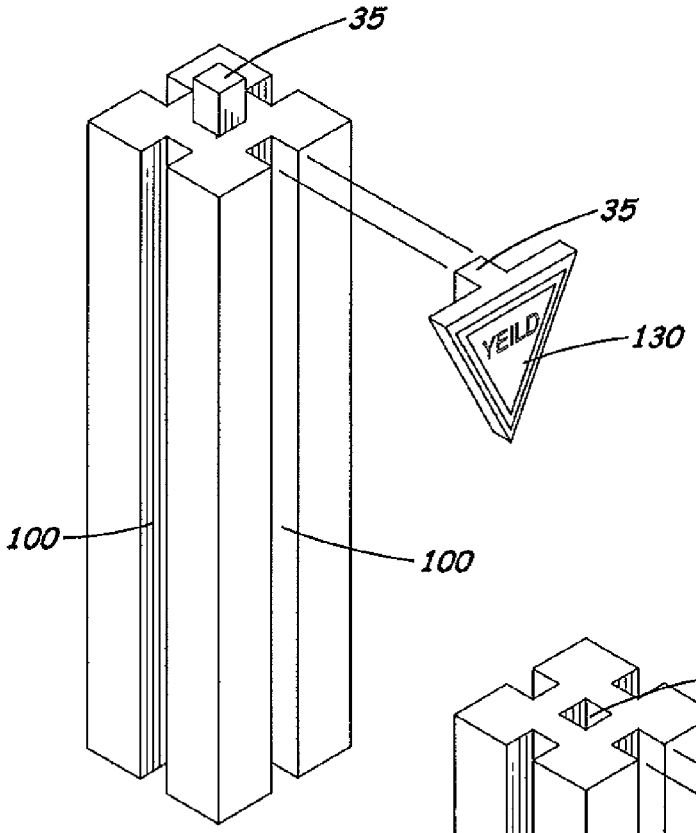

FIG. 11A shows a vertically routed pillar accepting an article configured as a road sign.

Figure 11B:
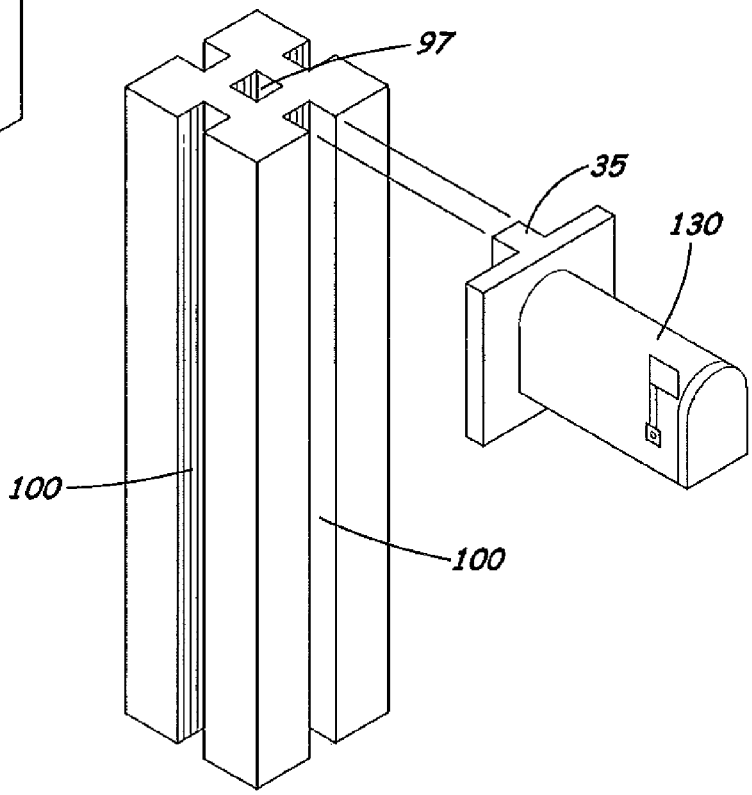

FIG. 11B shows a mailbox article for insertion into a pillar groove.

Figure 12:
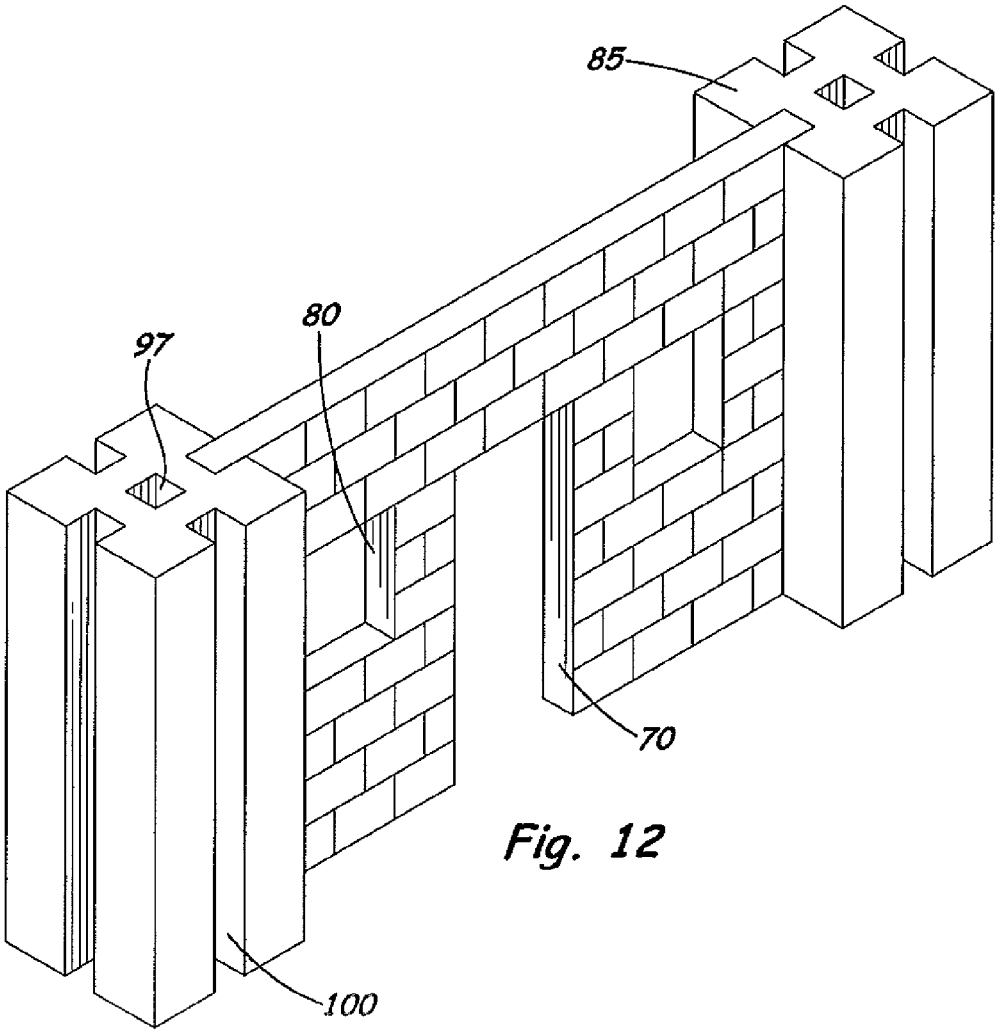

FIG. 12 shows dimensionalizing pillars with vertical routing connected by a wall element.

Figure 13A:
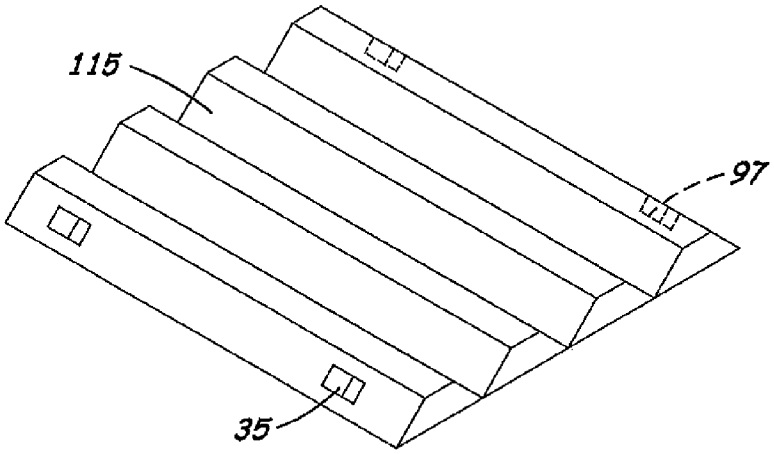

FIG. 13A shows a dimensionalizing form configured as a pillar, illustrating the flat posture prior to folding.

Figure 13B:
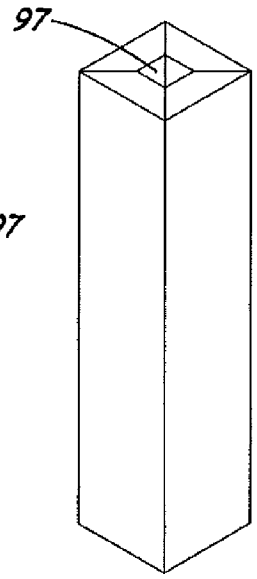

FIG. 13B shows a dimensionalizing form folded into a pillar.

Figure 13C:
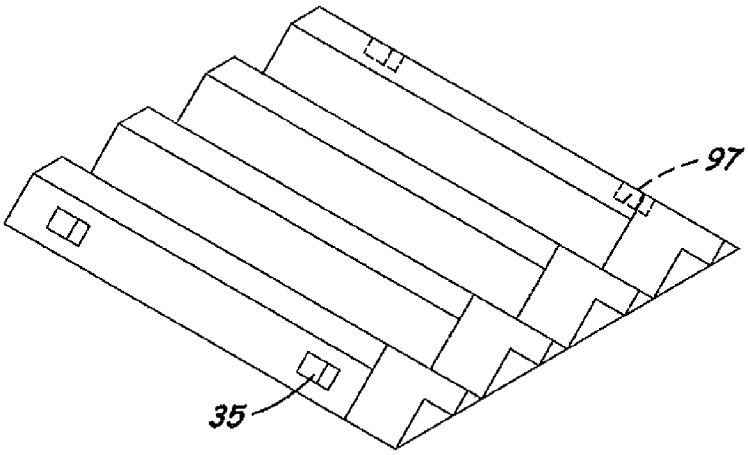

FIG. 13C shows a form with "V"-cuts defining a flat pillar prior to folding, with protrusions that form a jut.

Figure 13D:
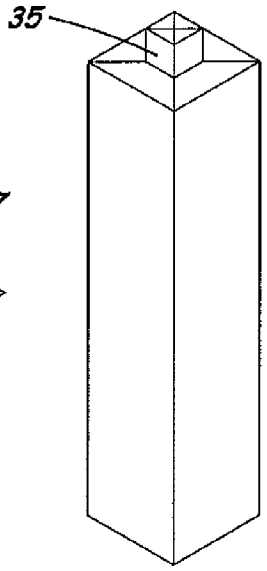

FIG. 13D shows a folded pillar with a jut and a jut port at its opposite end.

Figure 14A:
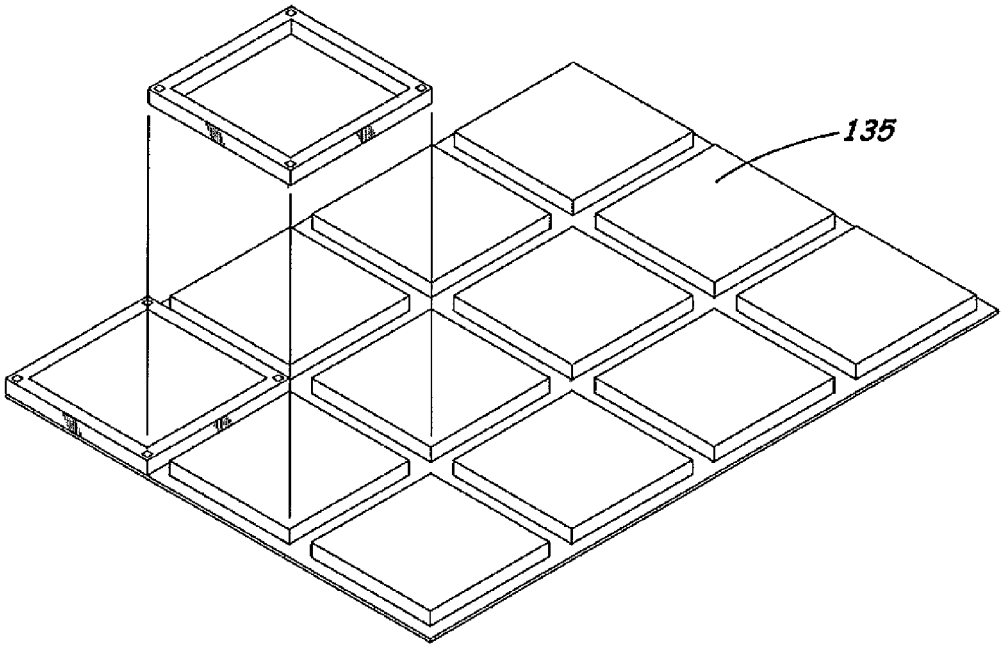

FIG. 14A shows a raised panel mat with a frame tile above for attachment on the mat.

Figure 14B:
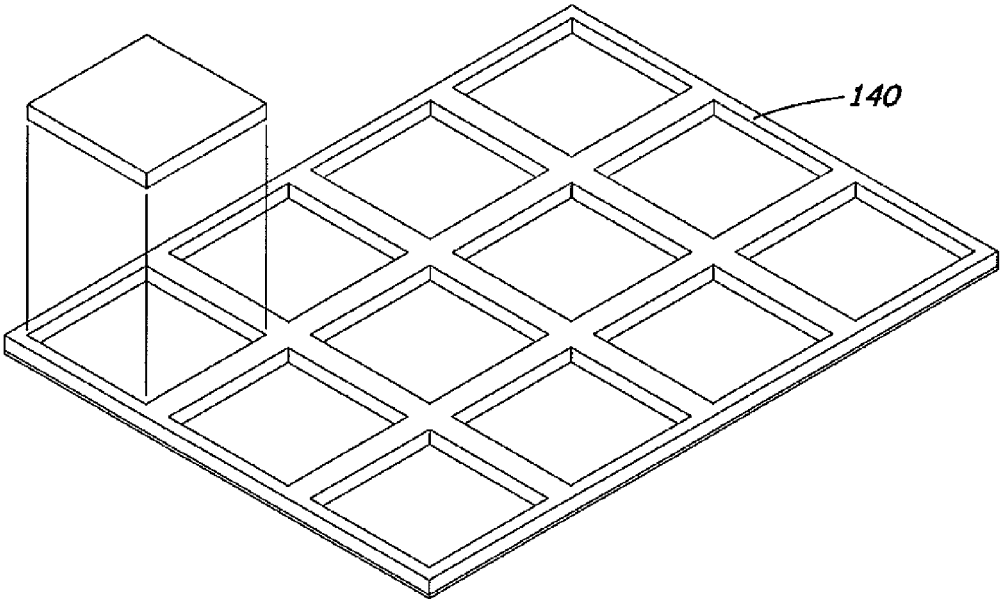

FIG. 14B shows a raised frame mat with a tile above for insertion in the mat.

Figure 15:
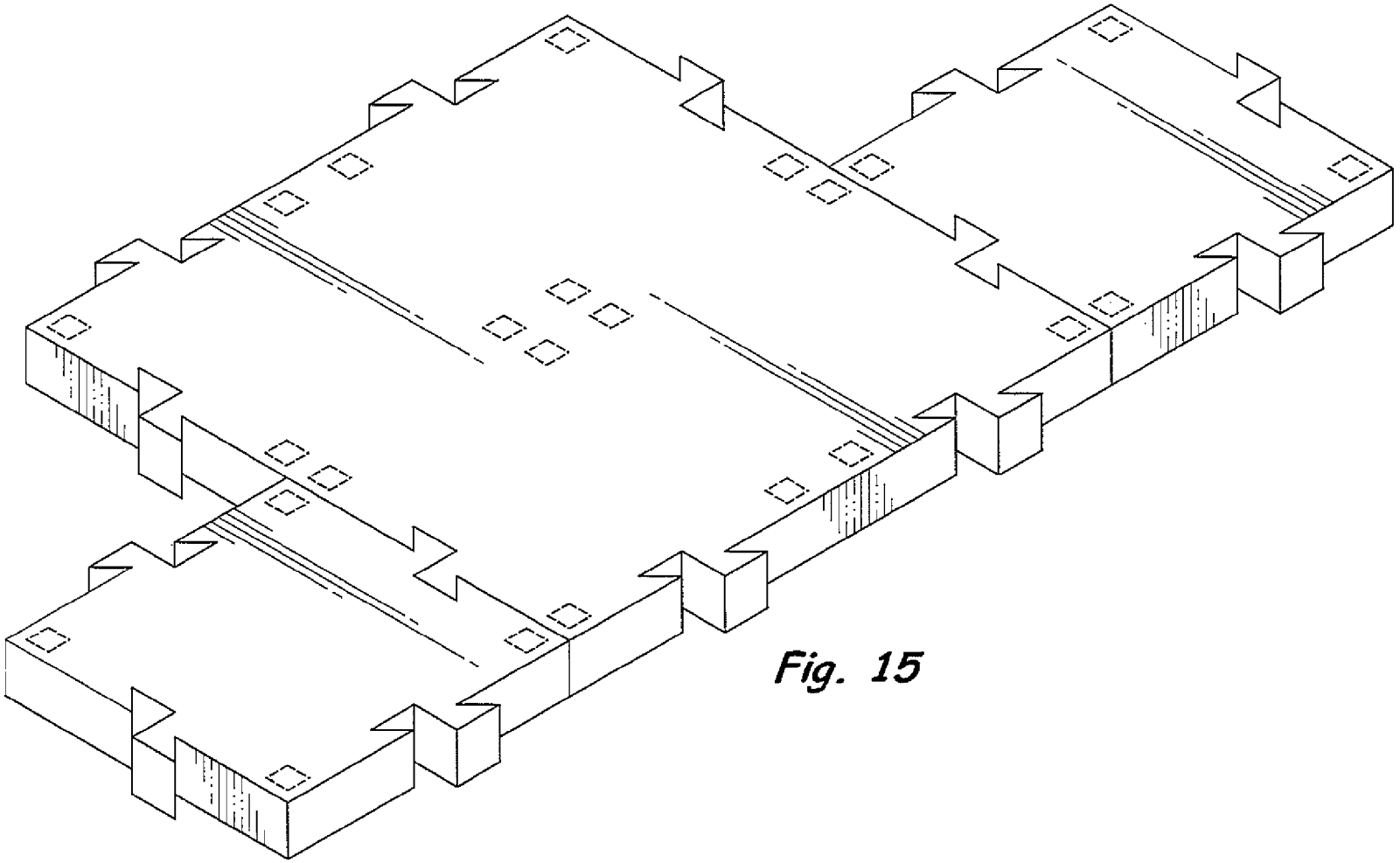

FIG. 15 shows continuous tiles of different scales tessellating, and the positions of the punch-outs.

Figure 16:
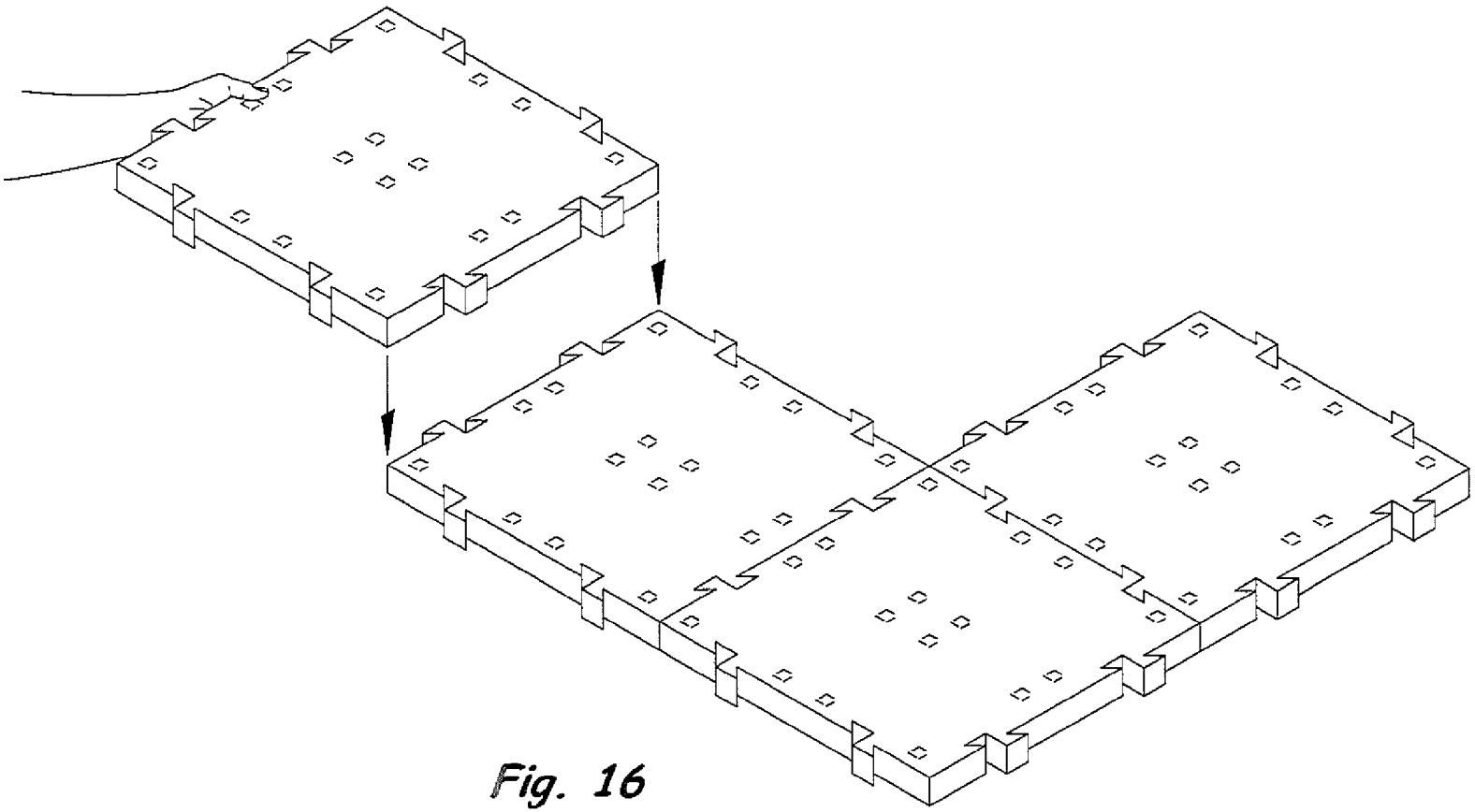

FIG. 16 depicts the tessellating nature of tiles of the set; continuous tiles are shown.

Figure 17:
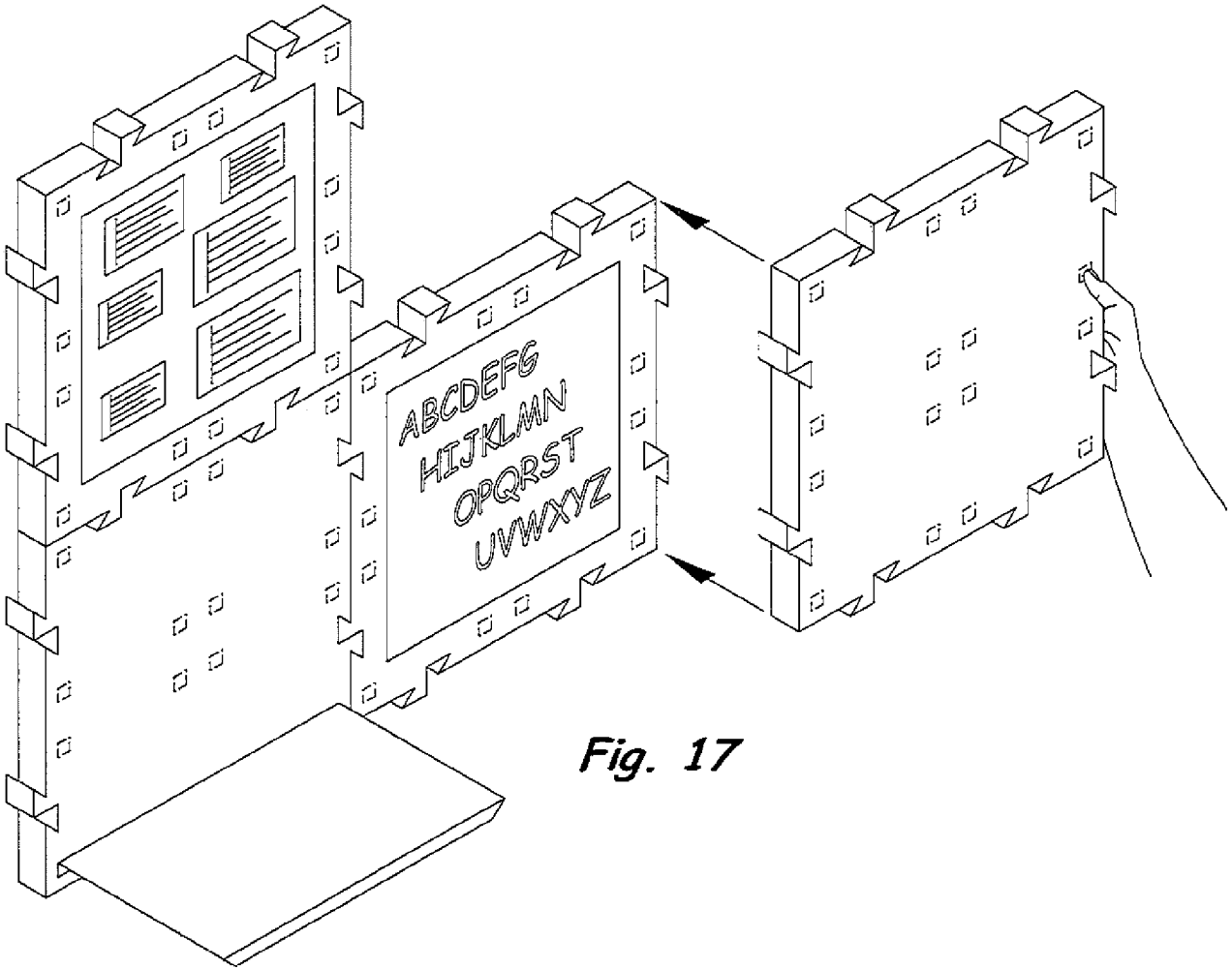

FIG. 17 shows the surfacescape used vertically as a display.

Figure 18:
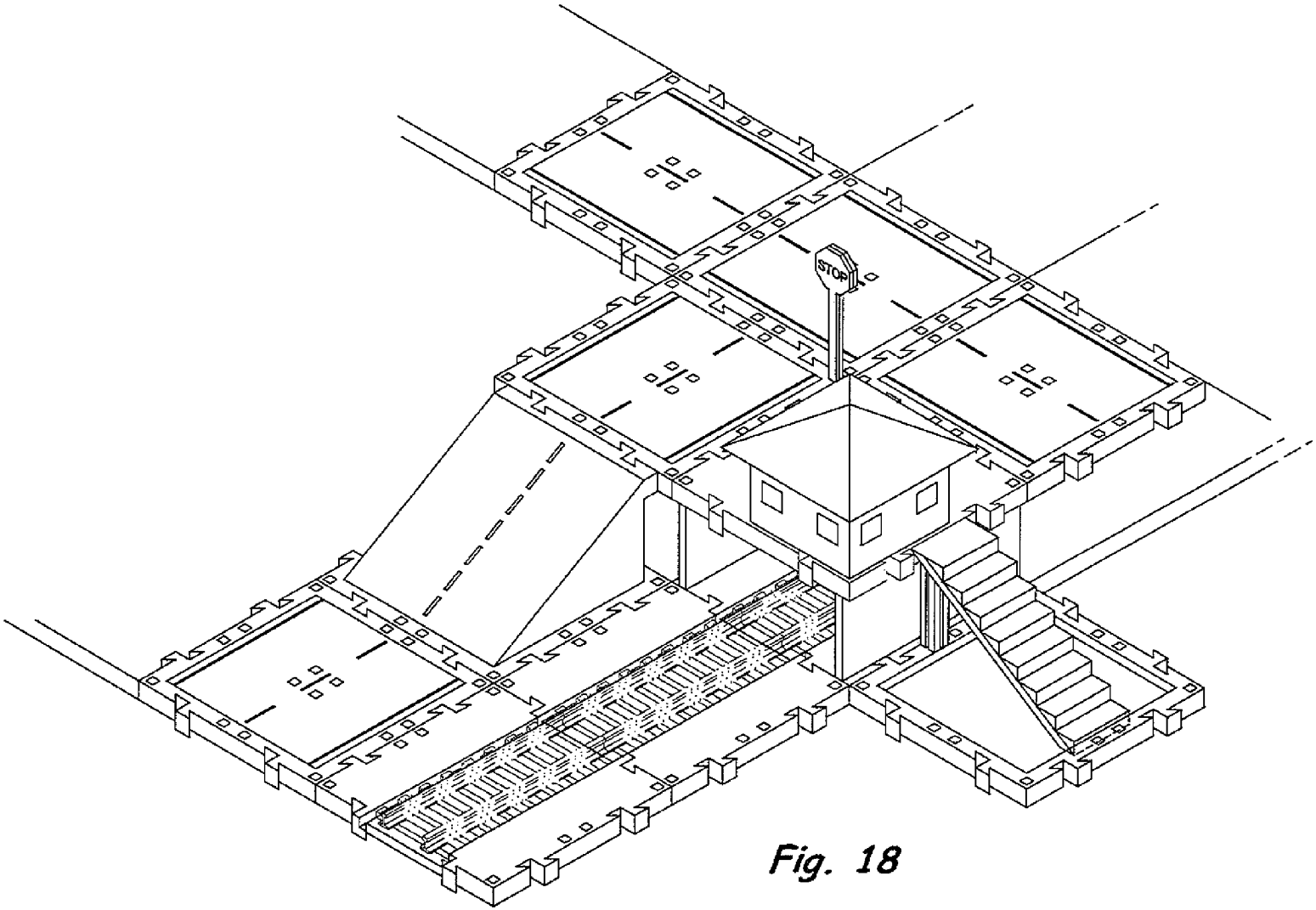

FIG. 18 shows the surfacescape used for play.

DETAILED DESCRIPTION

The invention described herein contemplates a set or system of individual component tiles that can transform a surface from a single dimensional area to a multi-dimensional, multi-directional surfacescape through the use of other tiles, support elements, and insertable articles embodying three-dimensional objects commonly encountered in landscapes, cityscapes and typical daily life. When used together, they compliment, support and stabilize each other. Component pieces of the set or system can be packaged and stored flat, then assembled and incorporated for multi-dimensional use as part of interactive play or display.

The tiles and insert components described are of varying multiple and proportional sizes, so that different scaled sizes will always interchangeably interact. For example, as shown in FIG. 15, two separate 3"×3" continuous tiles 1 would have one set of extensions 3 and recessions 5 on each side that would interact with one 6"×6" tile with two sets of extensions 3 and recessions 5 on each side. Similarly, two 6"×6" tiles with two sets of extensions 3 and recessions 5 on each side (or four 3"×3" tiles) would interact with one 12"×12" tile with four sets of extensions 3 and recessions 5 on each side. In this way, small travel sized components can be packaged for portability, and also be combined with larger components to enhance variety and utility of the invention in different play or display settings. Different types of tiles may be used interchangeably; the various tile types and scales reciprocally connect.

The interconnecting tiles can be aligned and connected by multiple means. They may include punch-outs 20 that allow for removal of a small area of the tile, which becomes a connector jut 95, to accommodate perpendicular or three dimensional elements, such as, but not limited to, juts 35 of other tiles, connector juts 95, long wall support forms 55, short wall support forms 60, or articles 130. The jut 35 portions of pillars 85, articles 130 or independent connector juts 95 created from the material removed from punch-outs fit within and occupy a punch-out 20 area or jut port 97. The connector juts 95 can also be made in various lengths and occupy a single or multiple material depth, or a portion therein, and may extend through and beyond the punch-out 20 depth. The punch-out 20 area may also accommodate the wall tabs 65 of support forms 53 configured as long wall support forms 55 and short wall support forms 60; each right angle triangular wall tab 65 occupies one half of the square punch-out 20 area, so that two walls with right triangular wall tabs 65 can meet and join, thereby occupying the entire punch-out 20 area. One skilled in the art would recognize that juts 35, connector juts 95, support form 53 wall tabs 65 and punch-outs 20 in other shapes or geometric configurations would achieve the same function, as long as they fit within, compliment proximate components, and occupy the punch-out 20 area. In addition to the punch-outs 20 that run through the tiles, each tile may be configured with one or more punch-outs 20 that extend partially through the tile on one surface to allow for tiles to be mounted on a wall and hung as a display or wall surface covering, while leaving the opposing surface continuous. In another means for connecting tiles, extensions 3 and recessions 5 can be used to align and connect proximately positioned tiles. Also, corner panels 105 that are either raised or routed from the tiles can be connected using a frame connector 110. Still a further means for connection of the component parts of the set or system incorporates panel tiles 34, raised panel mats 135, frame tiles 50, or raised frame mats 140 which secure and support the various elements of play or display and provide a mounting means.

Figure 1A:
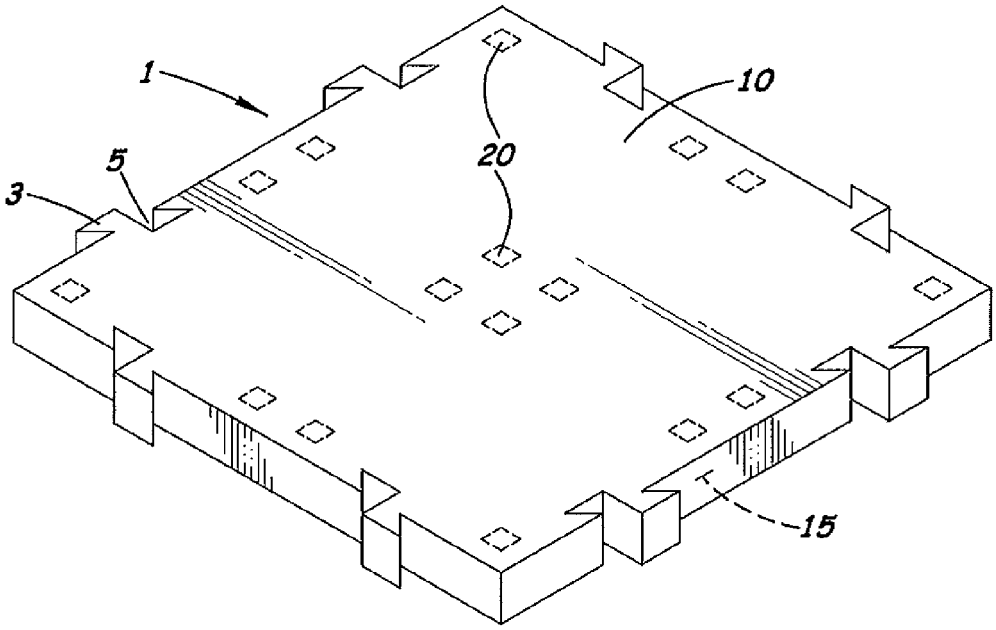
FIG. 1A shows a perspective view of the continuous tile with extensions and recessions as connection means, and punch-outs for dimensionalizing components, articles or additional connection means.
Figure 1B:
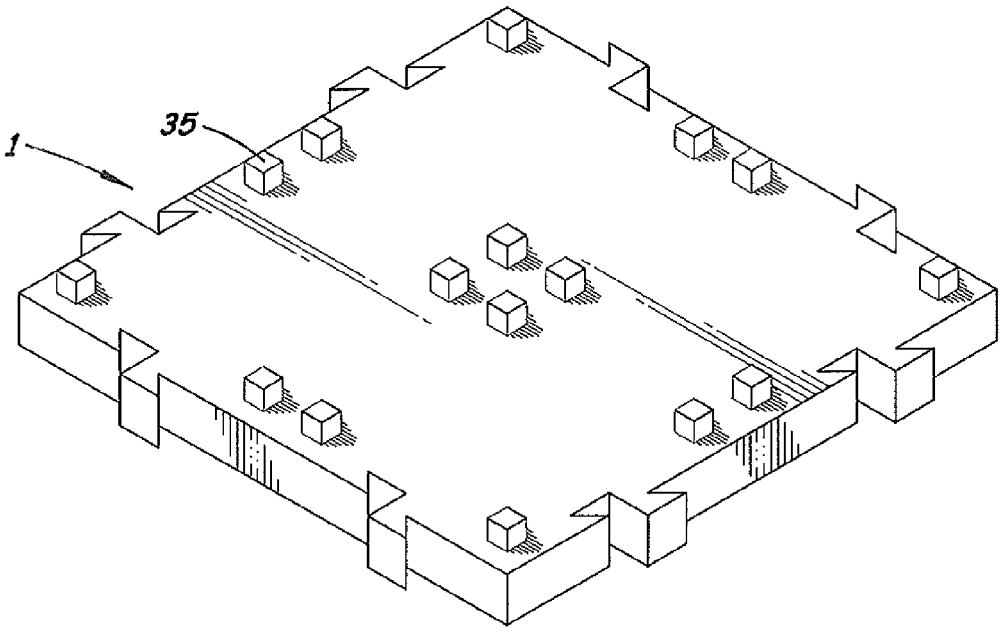
FIG. 1B shows a perspective view of the continuous tile with extensions and recessions as connection means, and juts for dimensionalizing components, articles or additional connection means.

FIG. 1 show two perspective views of different embodiments of a continuous tile 1. In FIG. 1A, the dotted lines represent punch-outs 20, which are cut from tiles and may be removed or reinserted by the user as connector juts 95 to accommodate three-dimensional elements, building components, pillars 85, articles 130, connecting or mounting parts or other complimentary and conforming inserts. FIG. 1B shows the continuous tile 1 configured with juts 35 instead of punch-outs 20, which fit conformingly within the punch-outs 20 of other tiles, jut ports 97, or within connector elements or articles 130. Punch-outs 20, jut ports 97, connector juts 95 and juts 35 provide a means for surface to surface building as well as adding dimensionalizing elements or articles 130 to tiles.

FIG. 1 also illustrate extensions 3 and recessions 5. Tiles of various configurations as further described herein may be placed next to each other along a surface. When tiles with extensions 3 and recessions 5 are used, they are aligned so that the extensions 3 of one tile can be inserted into the recessions 5 of the next tile; in this way, tiles can be releasably joined together to form a continuous tessellating surface. Tiles of different but proportional overall sizes as shown in FIG. 15 have the same size recessions 5 and extensions 3 and distances between them so that they may be interchanged between differently sized sets. All tiles may be surface ornamented or textured on one or both surfaces or sides; the ornamentation is capable of continuing between tiles and dimensionalizing elements. Another method for connecting tiles proximately positioned is to build upon a raised panel mat 135 or a raised frame mat 140 base, as shown and described in FIG. 14. Tiles may also be connected by using proportionately smaller frame tiles 50, or frame connectors 110, which fit conformingly over juts 35 or corner panels 105 on the perimeter of tiles adjacently positioned, as described in FIG. 5.

FIG. 2 show routed tiles 23 and surface ornamentation of travelways incorporating continuous and non-continuous lines and shapes in different possible embodiments. In the depicted embodiment of FIG. 2A, the routed channel 25 is used to hold and stabilize railroad tracks, one of many uses for the routed channel 25. Other uses include but are not limited to containing vehicles, objects, inserts, or ornamentation. Surface ornamentation of the travelways, as shown in FIG. 2C through 2M, can be included in the routed channel 125 or configured on a continuous surface to include watercourses, roadway or other travelway track beds, gardens or greenways, pathways, etc. Routing is formed by routing a channel or peripheral area in a continuous tile 1. FIG. 2A, FIG. 2B, and FIGS. 2C through 2M show a sample of possible variations of the routing shape, travelway ornamentation, and function. FIGS. 2C through 2M also illustrate that alternate possible ornamentation provides for continuity between proximate tiles of the set. One skilled in the art would recognize that there are multiple possible shapes and lines for routing a channel and surface ornamentation which could provide straight, curved or angled "turns" to create one or more lanes or travelways contained within a tile or continuing to other tiles on one or more sides or surfaces. Routed channel 25 areas and travelway lines and shapes would be sized to accept vehicles of various sizes or standard toy track or travelway commercially available in local or regional markets. The tiles depicted in FIG. 2A and FIG. 2B also include extensions 3 and recessions 5, although the side surfaces could be smooth and connection could be achieved by other means such as the use of panel tiles 34, raised panel mats 135, frame tiles 50, raised frame mats 140, or frame connectors 110.

FIG. 3 show a closed configuration frame tile 50 with insert tiles 30 variously configured and ornamented. The frame component comprises a first surface 10 and a recessed area into which insert tiles 30 are placed, in contact with the frame tile 50 on one or more sides or surfaces. Flat insert tiles 30 can be reversible, with different surfaces or ornamentation on different sides. Insert tiles 30 may be of varying material depth, dimensionalizing, or capable of traversing levels of play or display. In FIG. 3A, three variations of insert tiles are presented above the frame tile 50 into which they may be inserted. In FIG. 3B, a multi-dimensional insert tile 32 which connects two levels and includes extensions 3 and recessions 5 on its upper edge is shown; this is one method of connecting tiles in various levels of play and display. In addition to insert tiles 30 of many textures, colors or surface qualities, frame tiles 50 with recessed inner portions accept other components that can be interchanged after the surface is assembled, some of which are capable of attaching and extending to other levels, as shown by the sloping tile 33 configured as stairs in FIG. 3C. The sloping tile 33 has angled sides or edges that conform to and rest on the frame tile 50. The frame tile 50 frame component around a sloping tile 33, multi-dimensional insert tile 32, insert tile 30, and the complementing insert tile 30 itself may be of many shapes, including but not limited to square, round, triangular or irregularly shaped. Square insert tiles 30 are illustrated. Additionally, the closed configuration frame tile 50, or frame tile 50 with a surface extending at least part way through the tile, may include punch-outs 20, or a hole, or press aperture 40 in the bottom surface that allows the user to push upon the insert tile 30 to remove it from the frame tile 50.

FIG. 4 depict frame tiles 50 with punch-outs 20 capable of accepting panel tiles 34 with juts 35. In FIG. 4A, the panel tile 34 shown can be inserted into the frame and the juts 35 on the panel tile 34 can be inserted into the punch-outs 20 on the frame tile 50 to align, secure and maintain it thereon. In this way, tiles of various configurations can be stacked and the surfacescape can be built outwards or upwards. Frame tiles 50 and panel tiles 34 can contain multiple frames or panels that compliment or matingly conform to each other. Juts 35 on the frame periphery allow for alignment and stability of attachment between tiles. As with all tiles in the invention, they may or may not contain juts 35, punch-outs 20, extensions 3 and recessions 5, or combinations thereof, and the surfaces of the tiles can be ornamented, laminated, treated, or textured to accommodate a range of aesthetic or functional preferences. Also in FIG. 4, recessions 5 and extensions 3 are shown. The recessions 5 and extensions 3 are provided in one possible configuration; they could be in other complimentary or matingly conforming configurations capable of interlocking. As drawn, extensions 3 and recessions 5 are configured to include a first long straight side, a second side forming a 90 degree angle with the first straight side, and a third angled side returning back toward said first straight side to provide enhanced interlocking capacity between proximate tiles. When coupled, the tiles are continuous across the surface and form right angles at corners. This preferred embodiment is an improvement over existing interlocking tile configurations as many have alignment challenges; too many insert recesses and protrusions make it difficult to place or align tiles together. The present invention requires fewer recesses and protrusions and is easier to join, as it utilizes a straight side which optimizes ease of connection while allowing support of weight when the system is used by hanging on a vertical surface, as a display. It also facilitates multiple connection means which enhance and stabilize the connections between tiles. Tiles connected in this way are also an advantage over prior art in that corners of tiles will always line up.

In FIG. 4B, an open configuration frame tile 50 is shown, wherein the frame is open from the first surface 10 through the second surface 15. This figure is drawn with extensions 3, recessions 5 and punch-outs 20. Frame tiles 50 and the other tiles in the set can also be configured with smooth sides, corner panels 105, juts 35, or any combination thereof. They can also vary in material depth.

FIG. 5A illustrates a continuous tile 1 with smooth sides and corner panels 105 created by routing a channel into the surface, that would be connected to adjacent tiles with a frame connector 110, which accepts and holds together two or more corner panels 105 from adjacent tiles. The corner panels 105 from each tile occupy a portion of the frame connector 110, which is a relatively smaller version of an open configuration, smooth sided frame tile 50. When placed over and around the corner panels 105 or juts 35 of more than one tile, it can hold together and stabilize them.

FIG. 5B illustrates a smooth-sided panel tile 34 with multiple raised areas and corner panels 105. It also shows the multiple and proportional nature of the tiles. When these tiles are placed adjacently, either free standing or on a mat, the corners and sides meet, bringing together corner panels 105 which may be connected by frame connectors 110.

FIG. 5C shows the corner panel 105 and frame means of connecting tiles with a routed panel capable of creating a punch-out 20 when connected with other tiles by the frame connector 110. As illustrated in FIG. 5D, when the frame connector 110 is placed over the raised panels on the periphery of the tile, it is occupied by the corner panels 105 of the tiles being connected. If the corner panels are routed into an "L" shape, as the embodiment shown in FIG. 5C, the frame connector 110 completes an aperture area that now can serve as a punch-out 20 which is a partial material depth, accepting juts 35, connector juts 95 or other connecting elements.

Removeably blocked punch-outs 20 can also be included on these tiles to create a full material depth punch-out 20 area.

FIG. 5D shows adjacent frame tiles 50 connected by enclosing the corner panels 105 with the frame connector 110. This may be used in addition to other connecting means. As depicted, the frame connector 110 encloses the routed corner panels 105 of adjacently positioned tiles, connecting them and creating punch-out 20 areas. Adjacent tiles are shown as cutaways, and could be any type of tile in the set as long as proximate tiles are configured similarly and conformingly with regard to their connection means.

FIGS. 6 through 13 refer to the dimensionalizing forms including pillars 85 and support forms 53 or other elements used to extend the invention upward if used on a horizontal surface, and outward if used on a vertical surface to enable multi-dimensionality of the system. Dimensionalizing tiles are multi-dimensional insert tiles 32 or sloping tiles 33 with the capacity to interlock on subsequent levels.

In FIG. 6, one type of support form is drawn, shaped with extended side components, or wall tabs 65, that fit conformingly within punch-outs 20, and complement the shape of a proximate support form within the same punch-out 20 to fill it, mutually stabilizing the support forms upon a mat or tile. FIG. 6A shows a long wall support form 55 which can be combined with a short wall support form 60 shown in FIG. 6B. When multiple support forms are placed next to each other in perpendicular or parallel fashion, buildings, rooms, tunnels, and other separated and defined spaces can be created. The external sides (those opposite the punch-outs), with the extended side components or wall tabs 65 previously described, can fit in the punch-outs 20 on the underside of the next level of play or display, aligning, securing and stabilizing it thereon. FIG. 6C shows a basic building shaped by combining two longer with two shorter support forms, with the extended sides or wall tabs 65 revealed ready to accept and support the various levels of play or display. One skilled in the art would recognize that extended side components could be made of different shapes as long as they fit conformingly within punch-outs 20 matching their shape and complimentarily to adjacent support forms.

FIG. 7 illustrate support forms 53 with brick ornamentation, as one of many possible decorative surfaces that could be incorporated. FIGS. 7A, 7B and 7C show drive-through, solid and windowed configurations, respectively; one skilled in the art could recognize that many different openings, patterns of ornamentation, or combinations of these would fall within the contemplation of the disclosure presented. Door openings 70, window openings 80, solid wall 75 and other opening or ornamental embodiments are contemplated herein. These figures further show the extended side components, or wall tabs 65; in this embodiment they are triangular, although other shapes could be used as long as they are shaped to fit conformingly into punch-outs and complimentary to proximate components.

In FIG. 8, the support forms 53 described in FIGS. 6 and 7 are presented; they are shown from above the tile surface with wall tabs 65 being moved into position within the punch-outs 20. Each support form wall tab 65 in this embodiment occupies a portion of the punch-out 20 that is or may be complimented by positioning another support form next to it, to completely occupy the punch-out 20 area.

FIG. 9 shows articles 130 and connector juts 95 for a surfacescape, which may include complimentary elements common to landscapes or cityscapes, including landscape and travelway (roadway, railway, runway, waterway, and pathway) elements capable of being independently ornamented, textured, laminated, surfaced, conditioned or printed with indicia, formed in a variety of shapes, dimensions, and depths, including but not limited to telephone poles, street signs, stop lights, street lights, fire hydrants, trees, shrubs, fences, billboards, bridges, ramps, mailboxes, columns or supports for bridges and upper roadways, gas pumps, flags, flag poles, people, animals, or other objects or figures, which are further capable of insertion into or accepting tiles or pillars 85. Articles 130 are supplied and capable of packaging or storage flat, in a mirror-image 125 configuration. A relief cut, made by cutting to, but not through, a first surface 10 enables folding along a line of symmetry, and when folded are capable of filling a punch-out 20. FIG. 9A shows a stop sign article 130 in the flat, mirror-image 125 configuration, and FIG. 9B illustrates the same article 130 folded and ready for placement within a punch-out 20. FIGS. 9C and 9D similarly show an alternate embodiment of an article 130, as a flag or travelway sign. FIG. 9E shows a connector jut 95. FIG. 9F depicts the articles of FIG. 9A and FIG. 9B inserted into punch-outs 20 in a tile ornamented with checkerboard squares, in a tile embodiment including extensions 3 and recessions 5 and punch-outs 20.

Another way the system is connected and supported between levels for multi-dimensionalization employs cooperating dimensionalizing forms including pillars 85, which may be placed within and supported by the punch-outs 20 and thereby connect spatially upper and lower levels, and can additionally hold other elements that further stabilize and support the system. FIG. 10 depict pillars 85 that are routed vertically relative to the juts 35, horizontally, or in both directions to accept insertable elements. Pillars 85 can have juts 35, jut ports 97 or both, rendering them capable of insertion into punch-outs 20 or of accepting juts 35 or connector juts 95 which align, stabilize and support them. FIG. 10A shows a pillar 85 with vertical routing and a jut port 97, and FIG. 10B shows a vertically routed pillar 85 with both an inserted connector jut 95 and a jut port 97, with a connector jut 95 protruding centrally above the body of the pillar 85 and a jut port 97, shown as the dotted line extending internally from an opposite surface. FIG. 10C provides a view of a pillar 85 with a jut 35 protruding centrally above the body of the pillar 85 and a jut port 97. This figure further illustrates that a pillar 85 can be made in various lengths or with a horizontally routed pillar groove 100 in addition to the vertical routing, rendering them capable of accepting or receiving support elements along those planes. FIG. 10D shows a pillar 85 configured to include juts 35 or jut ports 97 in different surfaces. FIG. 10E is an angled pillar 90, which is capable of supporting sloping or other dimensionalizing components, and includes juts 35, jut ports 97, and horizontal as well as vertical routing. Pillars 85 and angled pillars 90 with none, one, or multiple juts 35 or jut ports 97 are contemplated.

In FIG. 11, vertically routed pillars 85 are shown accepting articles 130 with juts 35 or connector juts 95. FIG. 11A shows a roadway sign article 130, while FIG. 11B depicts a mailbox article 130. These removeably attachable articles 130 can be inserted into routed pillar grooves 100 or jut ports 97, or can be configured with jut ports 97 that can accept connector juts 95 that also fit into routed pillar groves 100 or jut ports 97, or can be configured with jut ports 97 instead that can attach directly to juts 35 on support or other set complimentary elements on any side or surface. Juts 35, connector juts 95, and jut ports 97, and punch-outs 20 can be made in any conforming, mating shape.

FIG. 12 shows cooperating, dimensionalizing pillars 85 with vertical routing connected by a wall element. The pillars 85 are connected by and anchored with the wall element, providing the capacity to support levels above them. Jut ports 97 are shown which can accept and stabilize juts 35, connector juts 95, articles 130, punch-outs 20 or other elements of the set in order to build upwards or outwards from the surface.

FIG. 13 depict the flat to folding nature of the support forms 53, and also illustrate the method of assembling a dimensionalizing pillar 85. A pillar 85 is shown as one example of dimensionalizing elements, which are initially flat, and created with a series of "V" cuts 115 or relief cuts. A relief cut goes from a first surface to, but not through, a second surface, which is maintained and serves as a folding or bending point. "V"-cuts are angled to allow for a filled central area, as shown in FIG. 13A. When folded, as in FIG. 13B, the pillar 85 takes a shape that is capable of insertion into punch-outs 20 or accepting juts 35 or connector juts 95. If the cut surfaces are leveled, the folded pillar will form a cavity capable of serving as a punch-out 20 or jut port 97. If folded differently the form is capable of becoming stairs. If the cut surfaces are pointed, and the flat configuration also includes a pointed protrusion at one or both ends, the pillar 85 will be solid, and one or more juts 35 will be created upon folding. FIG. 13C shows one end shaped to be capable of forming a jut 35 and one capable of becoming a jut port 97 upon folding. FIG. 13D depicts a folded pillar 85 with the jut 35 protruding from one end and a jut port 97 on the other end. Once folded together, the elements are capable of use as perpendicular supports for connecting and supporting multiple levels of play and display.

FIG. 14A and FIG. 14B show two separate embodiments of the mat. It is flexible and can roll or fold for portability or storage. In FIG. 14A, the raised panel mat 135 is depicted. This image includes a frame tile 50 above the raised panel mat 135, which fits over and encloses one or more panels when it is placed on the mat. Open or closed frame tile 50 configurations can be accepted and stabilized by the panels on the mat. Alternatively, a raised frame mat 140 can be used, as shown in FIG. 14B. In this embodiment, a tile is shown above the raised frame mat 140. When placed within the raised frame of this type of mat, the tile is held and supported therein. This mat configuration can also be used in the same way as frame tiles 50 work, with sloping insert tiles 32 or other dimensionalizing elements as shown in FIG. 3C to stabilize and support those elements.

In FIG. 15, the scalable and proportional feature of the invention is shown. Continuous tiles 1 of two different, but proportional sizes are presented. These multiple, proportional tiles cooperate interchangeably to connect, allow rotation, interact and lock on all sides. Relatively small tiles can connect with relatively large tiles as their extensions 3 and recessions 5 are the same size and location on each tile so that the smallest tile will remain relative to and useful with the largest one. Although FIG. 15 shows the connection means as extensions 3 and recessions 5, the tiles could also be connected by corner panels 105 and frame connectors 110 or by placing upon the complimentary connecting elements of the raised panel mat 135, raised frame mat 140, or by utilizing a combination of these connection means.

FIG. 15 also shows the positions of the punch-outs 20. Punch-outs 20 are positioned on the periphery of the smallest tile, in its corners. Tiles in the set or system can expand in size proportionally, but will always be scaled sizes of the smallest tile. Punch-outs 20 will be placed at regular intervals corresponding to those of the corners of the smallest tile. In this way, multiple punch-outs 20 will be positioned proximately to each tile's corner when that tile is connected with others. Where tiles meet, or where the corners come together, punch-outs 20 will line up to place multiple punch-outs 20 near each other, so that they are equidistant from each other and those on proximate tiles when they are coupled. Instead of or in addition to punch-outs 20, juts 35 can be incorporated at these relative locations.

FIG. 16 depicts the tessellating nature of tiles of the set. In this embodiment, continuous tiles 1 are shown, connected by extensions 3 and recessions 5. All tile types, and all scalable sizes, can be connected to expand multi-directionally and multi-dimensionally.

FIG. 17 shows the surfacescape used as a display, positioned vertically on a surface. As a display, the surfacescape can be horizontal or vertical. Continuous tiles 1, frame tiles 50, insert tiles 30, and a support form 53 are shown. The insert tiles 30 are placed within a frame tile 50 and are also shown with surface ornamentation. These tiles are connected through the use of extensions 3 and recessions 5.

FIG. 18 illustrates the surfacescape used for play on a horizontal surface, and shows the multi-directional and multi-dimensional capabilities and function of the various tiles as they interact to create multiple levels of play.

I claim:

1. A multi-functional, multi-directional, and multi-dimensional surface covering for play and display comprising:

I. A set of cooperating, interchangeable, tessellating tiles further comprising a plurality of opposing sides of equal length, ornamented surfaces, said surfaces including removably blocked punch-outs;

II. A set of cooperating, interchangeable dimensionalizing tiles, including multi-dimensional insert tiles and sloping tiles, capable of interacting with proximate tiles ornamentally and structurally to form structures or subsequent levels;

III. A set of cooperating, interchangeable dimensionalizing forms, including pillars and support forms, capable of interacting with proximate tiles to form structures or subsequent levels;

IV. Articles for a surfacescape shaped, ornamented, laminated, textured, surfaced, conditioned, or printed with indicia on one or more sides or surfaces to resemble elements commonly found in cityscapes, landscapes and on travelways that include roadways, railways, runways, waterways, and pathways; said articles include telephone poles, street signs, stop lights, street lights, fire hydrants, trees, shrubs, fences, billboards, bridges, ramps, mailboxes, columns or supports for bridges and upper roadways, gas pumps, flags, flag poles, people, animals, or other objects or figures related to cityscapes, landscapes or travelways that include roadways, railways, runways, waterways, and pathways, wherein said articles are capable of insertion into or accepting said tiles, said punch-outs or said pillars; and V. A set of cooperating, interchangeable and flexible tile mats with a raised panel or raised frame configuration wherein said flexible tile mats are a soft and relatively flexible, yet sturdy material, without sharp or hard edges and can roll or fold for portability or storage, can accept insert tiles, frame tiles, panel tiles, complementing raised or routed areas, or dimensionalizing elements to stabilize and support those elements;

wherein said cooperating, interchangeable tessellating tiles, dimensionalizing tiles, dimensionalizing forms, articles, and mats further comprise physical dimensions that are the same as, or multiples of or proportional to, and capable of cooperating with the surfaces, sides, and ornamentation of proximate tiles to render them vertically and horizontally continuous.

2. The multi-functional, multi-directional, and multi-dimensional surface covering of claim 1, wherein the cooperating, interchangeable, tessellating tiles and dimensionalizing tiles further comprise opposing surfaces that are independently ornamented, laminated, textured, coated, or treated to provide adhesive or decorative properties of various colors, travelways including roadways, railways, runways, waterways, and pathways, continuous or non-continuous lines, margins, scenery, shapes, alphabetic or numeric characters, or indicia; said opposing surfaces including at least a first surface and a second surface wherein one or more of said surfaces are continuous, routed, framed, paneled, or combinations thereof; said combinations including:

a continuous first surface and a continuous second surface;
a continuous first surface and a framed second surface;
a continuous first surface and a paneled second surface;
a continuous first surface and a routed second surface;
a framed first surface and a framed second surface;
a framed first surface and a paneled second surface;
a framed first surface and a routed second surface;
a paneled first surface and a paneled second surface;
a paneled first surface and a routed second surface;
a routed first surface and a routed second surface;
said tiles further including ornamentation which can be aligned between adjacent tiles to render them vertically and horizontally continuous; removably blocked punch-outs capable of continuing from said first surface to or through said second surface for inserting or attaching said tiles, said dimensionalizing tiles, said dimensionalizing forms, or said articles that allow perpendicular attachment, assembly and interconnection of multi-dimensional elements, other tiles and creation of multiple levels of play and display, or for mounting and for disassembly.

3. The multi-functional, multi-directional, and multi-dimensional surface covering of claim 1, wherein the cooperating, interchangeable dimensionalizing multi-dimensional insert tiles further comprise a plurality of opposing sides and a plurality of opposing surfaces including a first surface and a second surface wherein at least one said side or said surface extends outward from the plane of proximate tiles in multi-dimensional shapes, including mountains, ramps, steps, ladders, and rooftops.

4. The multi-functional, multi-directional, and multi-dimensional surface covering of claim 1, wherein the cooperating, interchangeable dimensionalizing sloping tiles further comprise a plurality of opposing sides and a plurality of opposing surfaces including a first surface and a second surface wherein at least one said side or said surface is sloping; said sloping side or said surface can be in scalable shapes, dimensions, and depths extending from one said surface to or through an opposite said surface which imparts continuous surface areas and open surface areas and renders ramps, slides, ladders, steps, and sloping surfaces capable of joining and supporting multiple levels of tiles.

5. The multi-functional, multi-directional, and multi-dimensional surface covering of claim 1, wherein the cooperating, interchangeable dimensionalizing forms include pillars wherein said pillars further comprise a plurality of sides and opposing surfaces wherein one or more said sides or said surfaces have at least one jut or at least one jut port on one or more said sides, said surfaces or both, capable of accepting said juts and said punch-outs from proximate tiles, forms, articles, pillars, or complimentary elements, thereby connecting multiple levels of play or display, or for attachment and interconnection.

6. The multi-functional, multi-directional, and multi-dimensional surface covering of claim 1, wherein the cooperating, interchangeable dimensionalizing forms include pillars wherein said pillars further comprise a plurality of sides and opposing surfaces wherein one or more of said sides or said surfaces are routed vertically, horizontally or both, forming recessed grooves capable of accepting tiles, forms, articles, or complementary elements.

7. The multi-functional, multi-directional, and multi-dimensional surface covering of claim 1, wherein the cooperating, interchangeable dimensionalizing forms have one or more of said sides, said surfaces, or both that are angled.

8. The multi-functional, multi-directional, and multi-dimensional surface covering of claim 1, wherein the cooperating, interchangeable dimensionalizing forms include dimensionalizing support forms that further comprise a first surface, a second surface, vertical sides, and horizontal sides; said vertical sides including mitered edges extending beyond said horizontal sides thereby forming insertable tabs that fit within punch-outs in tiles, allowing contact of said sides or said surfaces of tiles to form a top or roof surface of one level, or a bottom or floor surface of a subsequent level, when said insertable tabs are placed within cooperating said punch-outs or jut ports.

9. The multi-functional, multi-directional, and multi-dimensional surface covering of claim 1, wherein the cooperating, interchangeable dimensionalizing tiles, dimensionalizing forms and articles are made, sold and stored flat, and are folded into multi-dimensionalized elements along "V"-cuts or relief cuts.

10. The multi-functional, multi-directional, and multi-dimensional surface covering of claim 2, wherein the tiles further comprise surfaces that are ornamented with travelways including roadways, railways, runways, waterways, and pathways that are marked with one or more continuous or non-continuous lines, shapes or routed channels along one or more surfaces or one or more sides so that said travelways that include roadways, railways, runways, waterways, and pathways are extended by joining, combining or proximately placing a series of similarly ornamented or routed said tiles together that connect or align at the same relative positions along one or more said surfaces to enable self-aligning, expandable play travelways including roadways, railways, runways, waterways, and pathways capable of tessellating or changing by individual tile rotation for variations in directionality.

11. The multi-functional, multi-directional, and multi-dimensional surface covering of claim 2 wherein one or more sides or surfaces further comprise one or more extensions and one or more recessions, said recessions capable of receiving said extensions from proximately positioned tiles in order to releasably position and hold multiple, independently interchangeable tiles together thereby forming a multi-directional interlocking surface covering.

12. The multi-functional, multi-directional, and multi-dimensional surface covering of claim 11 wherein said extensions and said recessions are configured to include a long first straight side, a second side forming a ninety (90) degree angle with said first straight side, and a third angled side returning back toward said first straight side to provide enhanced interlocking capacity between proximate said tiles, and wherein when coupled, said tiles are continuous across the surface and form right angles at corners.

13. The multi-functional, multi-directional, and multi-dimensional surface covering of claim 2 wherein at least one side or surface is contiguous and does not include punch-outs.

14. The multi-functional, multi-directional, and multi-dimensional surface covering of claim 2 further comprising continuous tiles comprising a plurality of surfaces including a first surface and a second surface; a plurality of opposing sides of equal lengths with one or more extensions and one or more recessions in each of said sides, said recessions capable of receiving said extensions from proximately positioned tiles in order to releasably position and hold multiple, independently interchangeable tiles together thereby forming a multi-directional surface covering; removably blocked punch-outs capable of continuing from said first surface to or through said second surface for inserting or attaching upright elements that allow vertical attachment, assembly and interconnection of multi-dimensional elements and creation of multiple levels of play and display or for mounting or removability; and ornamentation with various colors, travelways including roadways, railways, runways, waterways, and pathways, scenery, alphabetical or numeric characters, textures, or indicia; wherein continuous tile surface depths and side lengths are the same as or multiples of, proportional to and capable of connecting with the sides, surfaces, and ornamentation of proximate tiles to render them vertically and horizontally continuous.

15. The multi-functional, multi-directional, and multi-dimensional surface covering of claim 2 further comprising routed tiles wherein at least one surface is routed from one or more surfaces or one or more sides inward to form at least one routed channel extending partially across said surface area or fully across said surface area toward or to one or more adjacent or opposite said sides in a variety of shapes, dimensions, and depths which imparts partial frame orientations to said routed tiles; said routed channel capable of insertion into, accepting, or stabilizing complementary insert tiles, toy vehicles, objects, elements, tracks, travelways that include roadways, railways, runways, waterways, and pathways, or combinations thereof when placed or drawn within said routed channel.

16. The multi-functional, multi-directional, and multi-dimensional surface covering of claim 2 further comprising frame tiles wherein one or more surfaces is routed to form one or more frames; said frame or frames can be in a variety of shapes, dimensions and depths extending from said first surface to or through said second surface to impart closed or open frame orientations to said frame tiles, and which can accept and stabilize other set tiles including insert tiles and complimentary panel tiles when placed within said frame rendering it capable of insertion into, accepting, or stabilizing complementary panel or insert tiles, or interacting with tile mats with raised panels.

17. The multi-functional, multi-directional, and multi-dimensional surface covering of claim 2 further comprising insert tiles comprising a first surface, a second surface, and one or more sides, wherein said first surface and said second surface are independently ornamented, laminated, textured, coated or treated to provide adhesive or decorative properties, said tiles capable of being inserted into routed tile or routed channel or frame tile and maintained therein by said first surface, said second surface, said routed tile, said routed channel, said frame, or a combination thereof, and further capable of facing either side outwardly to increase the variety of visual or functional surface capacity.

18. The multi-functional, multi-directional, and multi-dimensional surface covering of claim 2 further comprising panel tiles wherein one or more surfaces is routed along the surface sides inward to form one or more raised interior panels and one or more recessed frames or channels extending along surfaces and sides in a variety of shapes, dimensions, and depths, said panel tiles capable of insertion into, accepting, or stabilizing complementary frame tiles and insert tiles, or interacting with tile mats with raised frames.

19. The multi-functional, multi-directional, and multi-dimensional surface covering of claim 2 additionally comprising indented areas or grooves in one or more said surfaces for mounting or interconnection of said tiles.

20. The multi-functional, multi-directional, and multi-dimensional surface covering dimensionalizing tiles of claim 2 further comprising juts conforming to punch-outs to attach and maintain proximate tiles or other multi-dimensional elements.

21. The multi-functional, multi-directional, and multi-dimensional surface covering of claim 2 further comprising corner panels defined by raised areas and recessed channels in the periphery of one or more of the tile surfaces, capable of conformingly pairing with or attaching to one or more proximately positioned tiles with said corner panels wherein the pairing or attachment means is a frame connector placed over and pressed down into the recessed channels around said corner panels of tiles to be connected, wherein said frame connector is occupied by said corner panels and thereby retains them.

22. The multi-functional, multi-directional, and multi-dimensional surface covering of claim 1 wherein the cooperating, interchangeable and flexible tile mat with raised panel configuration further comprises multiple raised panels and multiple recessed frames, or channels, that are capable of accepting and stabilizing tiles of the set with frames or complementing raised or routed areas, thereby creating a continuous surface; said raised panel mat further comprises non-slip or adhesive backing, and is capable of folding or rolling for storage and portability.

23. The multi-functional, multi-directional, and multi-dimensional surface covering of claim 1 wherein the cooperating, interchangeable and flexible tile mat with raised frame configuration further comprises multiple raised frames and multiple recessed panels that are capable of accepting and stabilizing tiles of the set with panels or complimenting raised or routed areas, thereby creating a continuous surface; said raised frame mat further comprises non-slip or adhesive backing, and is capable of folding or rolling for storage and portability.

24. A method of creating a multi-functional, multi-directional, and multi-dimensional play system comprising:

a.) providing a set of cooperating, interchangeable tessellating tiles, a set of cooperating, interchangeable dimensionalizing tiles, a set of cooperating, interchangeable dimensionalizing forms, articles for a surfacescape, and a set of cooperating, interchangeable and flexible tile mats;

b.) laying or hanging a mat or tile along a vertical or horizontal surface and aligning proximate sides, surfaces, or ornamentation of additional tiles or mats such that they cooperate, interact, connect, and stabilize each other to form a first level surface arranged according to the user's preference;

c.) aligning proximate sides, surfaces, or ornamentation of dimensionalizing tiles upon a first level of mats or tiles to form structures and interconnect said first level to a subsequent level of play arranged according to the user's preference;

d.) inserting juts or tabs of dimensionalizing forms into the punch-out areas of mats, tiles, or dimensionalizing tiles to form structures, or to support and interconnect said first level to a subsequent level of play arranged according to the user's preference;

e.) adding articles for a surfacescape into the punch-out areas of mats, tiles, or dimensionalizing tiles or into the juts, jut ports or grooves on dimensionalizing forms to create a surfacescape arranged according to the user's preference;

f.) continuing the steps to join, support, and create multiple levels and directions of play;

g.) connecting, rotating, removing, and reconstructing mats, tiles, dimensionalizing tiles, dimensionalizing forms, and articles for a surfacescape to form playscapes, travelways including roadways, railways, runways, waterways, and pathways, and scenes capable of continuing in multiple directions and dimensions;

h.) adding vehicles and play toy elements to place and play with along tiles;

i.) removing the vehicles and play toy elements, and disassembling the tiles, mats, forms, and articles of the set.

25. A method of creating a multi-functional, multi-directional, and multi-dimensional display system comprising:

a.) providing a set of cooperating, interchangeable tessellating tiles, a set of cooperating, interchangeable dimensionalizing tiles, a set of cooperating, interchangeable dimensionalizing forms, a set of cooperating articles for a display, and a set of cooperating, interchangeable and flexible tile mats;

b.) laying or hanging a mat or tile along a vertical or horizontal surface and aligning proximate sides, surfaces, or ornamentation of additional tiles or mats such that they cooperate, interact, connect, and stabilize each other to form a first level surface arranged according to the user's preference;

c.) placing and attaching tiles ornamented with messages, information or indicia by inserting them into frames or inserting juts or tabs into punch-outs on proximately positioned tiles to form a multi-dimensional display;

d.) aligning proximate sides, surfaces, or ornamentation of dimensionalizing tiles upon the first level of mats or tiles to form structures and interconnect said first level to a subsequent level of display arranged according to the user's preference;

e.) inserting juts or tabs of dimensionalizing forms into the punch-out areas of mats, tiles, or other dimensionalizing forms to create structures, provide support, and interconnect said first level to a subsequent level of display arranged according to the user's preference;

f.) adding insert tiles or articles into the punch-out areas or frames of mats, tiles, or into the juts, jut ports, or grooves on dimensionalizing forms of subsequent levels to create a multi-dimensional display according to the user's preference;

g.) continuing the steps to join, support, and create multiple levels and directions of display;

h.) connecting, rotating, removing, and reconstructing mats, tiles, dimensionalizing tiles, dimensionalizing forms, and articles for a display to form a variety of display areas capable of continuing in multiple directions and dimensions;

i.) removing and disassembling the tiles, mats, forms, and articles of the set.

* * * * *